US012269627B2

(12) United States Patent
Williams et al.

(10) Patent No.: US 12,269,627 B2
(45) Date of Patent: Apr. 8, 2025

(54) GAS-BASED MATERIAL COMPRESSION AND PORTIONING

(71) Applicant: Altria Client Services LLC, Richmond, VA (US)

(72) Inventors: Dwight David Williams, Powhatan, VA (US); James David Evans, Chesterfield, VA (US); Patrick Sean McElhinney, Chesterfield, VA (US); Jarrod Wayne Chalkley, Mechanicsville, VA (US)

(73) Assignee: Altria Client Services LLC, Richmond, VA (US)

( * ) Notice: Subject to any disclaimer, the term of this patent is extended or adjusted under 35 U.S.C. 154(b) by 69 days.

(21) Appl. No.: 18/446,020

(22) Filed: Aug. 8, 2023

(65) Prior Publication Data

US 2023/0382571 A1 Nov. 30, 2023

Related U.S. Application Data

(63) Continuation of application No. 17/533,735, filed on Nov. 23, 2021, now Pat. No. 11,753,190, which is a (Continued)

(51) Int. Cl.
*B65B 1/24* (2006.01)
*B65B 1/32* (2006.01)

(Continued)

(52) U.S. Cl.
CPC ..... *B65B 1/24* (2013.01); *B65B 1/32* (2013.01); *B65B 1/38* (2013.01); *B65B 29/00* (2013.01); *B65B 37/20* (2013.01)

(58) Field of Classification Search
CPC .. B65B 1/24; B65B 1/32; B65B 37/20; B65B 29/00; B65B 1/38; B65B 1/20

(Continued)

(56) References Cited

U.S. PATENT DOCUMENTS 1,351,903 A 9/1920 Hara
1,913,291 A 6/1933 Rountree (Continued)

FOREIGN PATENT DOCUMENTS

DE 2655036 A1 6/1978
EP 3147224 A1 3/2017

OTHER PUBLICATIONS

U.S. Non-Final Rejection dated Apr. 29, 2021 for U.S. Appl. No. 15/975,087.

(Continued)

*Primary Examiner* — Daniel Jeremy Leeds
*Assistant Examiner* — Katie L Gerth
(74) *Attorney, Agent, or Firm* — Harness, Dickey & Pierce, P.L.C.

(57) ABSTRACT

An apparatus configured to provide portioned instances of a compressible material includes a channel assembly, a gas source, a cutting assembly, and a discharge assembly. The channel assembly holds a bulk instance of the material extending through upper and lower channels of a continuous channel. The gas source supplies gas to compress the bulk instance. The cutting assembly moves in relation to the channel assembly to isolate the upper and lower channels, severing upper and lower material portions of the bulk instance. The discharge assembly directs gas to impinge on a lower face of the cutting assembly to discharge the lower material portion as a portioned instance. The channel assembly may be moveable, where operation of the gas source, cutting assembly, and/or discharge assembly are based on moving the channel assembly between various positions. The gas supply may be controlled based on a determined property of the portioned instance.

20 Claims, 20 Drawing Sheets

Related U.S. Application Data continuation of application No. 15/975,087, filed on May 9, 2018, now Pat. No. 11,192,668.

(51) Int. Cl.
*B65B 1/38* (2006.01)
*B65B 29/00* (2006.01)
*B65B 37/20* (2006.01)

(58) Field of Classification Search
USPC ..... 53/437, 438
See application file for complete search history.

(56) References Cited

U.S. PATENT DOCUMENTS 2,414,152 A 1/1947 Jackson
3,478,632 A 11/1969 Schmermund
3,530,915 A 9/1970 Moriuchi
3,552,454 A * 1/1971 Deming, Sr. ..... B65B 1/24 141/237
3,798,456 A * 3/1974 Marek ..... G01N 23/203 250/358.1
3,978,987 A * 9/1976 Neville ..... G01N 23/12 250/359.1
4,168,599 A 9/1979 King
4,457,125 A * 7/1984 Fishburne ..... B65B 63/028 53/527
4,538,492 A 9/1985 Van Lue et al.
4,640,322 A * 2/1987 Ballester ..... B65B 1/36 222/630
4,644,838 A 2/1987 Samson et al.
4,976,296 A * 12/1990 Pope ..... B65B 39/04 141/46
5,041,297 A * 8/1991 Dowaliby ..... B65B 1/36 53/529
5,234,037 A * 8/1993 Derby ..... B65B 1/26 222/394
5,244,019 A * 9/1993 Derby ..... B65B 1/26 222/452
5,401,156 A 3/1995 Anderson
5,404,919 A * 4/1995 Felts ..... B65B 1/24 141/93
5,458,055 A 10/1995 Fitch, Jr.
5,841,851 A 11/1998 Recht et al.
7,210,507 B2 * 5/2007 Facchini ..... A61J 3/074 141/144
8,602,068 B2 * 12/2013 Williams ..... B65B 37/20 131/108
10,000,301 B2 * 6/2018 Williams ..... B65B 37/14
10,399,712 B2 * 9/2019 Longest, Jr. ..... B65B 1/36
10,888,108 B2 * 1/2021 Longest ..... A24F 23/02
11,534,933 B2 12/2022 Saccone, Jr.
2007/0131707 A1 * 6/2007 Poole ..... B65B 1/12 222/14
2008/0202532 A1 * 8/2008 Wygal ..... B65B 63/02 131/111
2008/0236701 A1 * 10/2008 Monti ..... B65B 1/36 222/630
2009/0229705 A1 * 9/2009 Ansaloni ..... A61J 3/074 141/238
2010/0071711 A1 * 3/2010 Boldrini ..... B65B 61/08 131/112
2010/0263510 A1 * 10/2010 Klockow ..... B26D 1/36 83/162
2011/0277878 A1 * 11/2011 Williams ..... B65B 37/14 222/1
2012/0055493 A1 * 3/2012 Novak, III ..... B65B 61/28 131/111
2012/0060446 A1 * 3/2012 Merz ..... B65B 37/20 53/167
2012/0279178 A1 * 11/2012 Griscik ..... B65B 63/00 53/111 R
2015/0183532 A1 * 7/2015 Longest, Jr. ..... B65B 1/16 53/452
2016/0104339 A1 4/2016 Saccone, Jr.
2017/0015446 A1 * 1/2017 Frabetti ..... B65B 1/32
2017/0029142 A1 * 2/2017 Evans ..... B65B 1/36
2020/0233002 A1 7/2020 Las Navas Garcia
2021/0129369 A1 5/2021 Saccone, Jr.
2022/0088816 A1 3/2022 Williams et al.

OTHER PUBLICATIONS

U.S. Notice of Allowance for U.S. Appl. No. 16/275,927, dated Jul. 23, 2021.
U.S. Notice of Allowance for U.S. Appl. No. 15/975,087, dated Aug. 20, 2021.
U.S. Non-Final Rejection dated Jan. 6, 2023 for U.S. Appl. No. 17/533,735.
U.S. Notice of Allowance for U.S. Appl. No. 17/542,849, dated Feb. 1, 2023.
U.S. Notice of Allowance for U.S. Appl. No. 17/533,735, dated May 11, 2023.
Corrected U.S. Notice of Allowance for U.S. Appl. No. 17/533,735, dated May 24, 2023.

* cited by examiner

GAS-BASED MATERIAL COMPRESSION AND PORTIONING

CROSS-REFERENCE TO RELATED APPLICATIONS

This application is a continuation application of U.S. application Ser. No. 17/533,735 filed on Nov. 23, 2021, which is a continuation application of U.S. application Ser. No. 15/975,087 filed on May 9, 2018, the entire contents of each of which are hereby incorporated by reference.

BACKGROUND

Field

The present disclosure relates to portioning of compressible materials, and more particularly to compressing and portioning materials to provide rapid, economical, and efficient portioning of the materials to provide ("manufacture") portions ("instances") of material having a controllable density, weight, and volume.

Description of Related Art

Some products, including some consumer goods, include packaged portions ("portioned instances") of a compressible material (also referred to herein as simply a "material"). In some cases, such portioned instances may be produced ("provided," "manufactured," etc.) based on portioning ("segmenting," "cutting," "severing," etc.) a relatively large ("bulk") instance of the material into multiple smaller portioned instances and packaging the portioned instances.

SUMMARY

Some example embodiments utilize one or more supplies of gas to compress a bulk instance of material and to discharge portioned instances of material. Such a use of gas may enable relatively simple and rapidly and easily adjustable control of material compression and discharge with reduced apparatus complexity, reduced maintenance requirements, and/or reduced risk of disrupting a target density and/or volume of the portioned instances of material during the discharge of said instances from the apparatus.

According to some example embodiments, an apparatus configured to provide a portioned instance of a compressible material may include a channel assembly, a gas source, a cutting assembly, and a discharge assembly. The channel assembly may include an upper assembly and a lower assembly. The upper assembly may include an upper inner surface defining an upper channel. The lower assembly may include a lower inner surface defining a lower channel. The upper inner surface and the lower inner surface may collectively at least partially define a continuous channel including the upper and lower channels. The upper assembly may define a top opening of the continuous channel. The lower assembly may define a bottom opening of the continuous channel. The channel assembly may be configured to hold a bulk instance of the compressible material extending continuously through both the upper channel and the lower channel. The gas source may be configured to supply a first gas through the top opening to compress the bulk instance held within the continuous channel, such that the bulk instance includes an upper material portion in the upper channel and a lower material portion in the lower channel. The cutting assembly may be configured to move in relation to the channel assembly to extend transversely through the continuous channel between the upper channel and the lower channel, such that the lower material portion is severed from the upper material portion to produce the portioned instance, and the cutting assembly isolates the lower channel from the upper channel. The discharge assembly may be configured to supply a second gas into the lower channel to discharge the portioned instance through the bottom opening based on directing the second gas through a conduit assembly of the lower assembly to impinge on a lower face of the cutting assembly in the lower channel.

The channel assembly may be configured to move and the gas source is fixed in relation to the channel assembly, such that the gas source is configured to supply the first gas through the top opening based on the channel assembly moving to a first position to be in fluid communication with the gas source. The gas source may be configured to supply a continuous supply of the first gas, such that the supply of the first gas through the top opening of the channel assembly is controlled based on the channel assembly moving in relation to the first position.

The channel assembly may be configured to move and the cutting assembly is fixed in relation to the channel assembly, such that the cutting assembly is configured to extend transversely through the continuous channel based on the channel assembly moving to a second position.

The channel assembly may be configured to move and the discharge assembly is fixed in relation to the channel assembly, such that the discharge assembly is configured to direct the second gas into the lower channel based on the channel assembly moving to a third position to be in fluid communication with the discharge assembly.

The apparatus may further include a rotatable assembly configured to rotate around a central longitudinal axis. The rotatable assembly may include a plurality of channel assemblies. The plurality of channel assemblies may be spaced apart around a circumference of the rotatable assembly. The plurality of channel assemblies may include the channel assembly. The gas source, the cutting assembly, and the discharge assembly may be fixed in relation to the rotatable assembly, such that the gas source is configured to supply the first gas through the top opening based on the rotatable assembly rotating to move the channel assembly to a first position to be in fluid communication with the gas source, the cutting assembly is configured to extend transversely through the continuous channel based on the rotatable assembly rotating to move the channel assembly to a second position, and the discharge assembly is configured to direct the second gas into the lower channel based on the rotatable assembly rotating to move the channel assembly to a third position to be in fluid communication with the discharge assembly. The first position, the second position, and the third position may be different from each other. The gas source may be configured to supply a continuous supply of the first gas to at least a portion of the plurality of channel assemblies, such that the apparatus is configured to control the supply of the first gas to the channel assembly based on rotating the rotatable assembly to move the channel assembly to the first position.

The conduit assembly of the lower assembly may include an annular conduit assembly defining an annular conduit surrounding the lower channel, the annular conduit assembly configured to direct the second gas from the discharge assembly into the annular conduit and one or more bridging conduit assemblies defining one or more bridging conduits extending between the annular conduit assembly and a top end of the lower inner surface, the one or more bridging conduit assemblies configured to direct the second gas from the annular conduit to a top portion of the lower channel. The lower assembly may include a plurality of bridging conduit assemblies between the annular conduit assembly and the top end of the lower inner surface, the plurality of bridging conduit assemblies including the one or more bridging conduit assemblies, and the plurality of bridging conduit assemblies may be spaced apart equidistantly around a circumference of the lower inner surface.

The gas source may be configured to supply the first gas to the channel assembly at a positive pressure that exceeds an absolute pressure of an ambient environment surrounding the apparatus.

The apparatus may include a weight sensor configured to generate sensor data indicating a weight of the portioned instance that is discharged through the bottom opening, and a control device communicatively coupled to the gas source and the weight sensor, the control device configured to adjustably control a pressure of the first gas supplied to the channel assembly based on processing the sensor data, such that a weight of subsequently-provided portioned instances is maintained within a particular range.

The first gas and the second gas may be a common gas.

The continuous channel may be a cylindrical channel.

According to some example embodiments, an apparatus configured to provide a portioned instance of a compressible material may include a rotatable assembly configured to rotate around a central longitudinal axis. The rotatable assembly may include a plurality of channel assemblies. The plurality of channel assemblies may be spaced apart around a circumference of the rotatable assembly. Each channel assembly of the plurality of channel assemblies may include an upper assembly and a lower assembly. The upper assembly may include an upper inner surface defining an upper channel. The lower assembly may include a lower inner surface defining a lower channel. The upper inner surface and the lower inner surface may collectively at least partially define a continuous channel including the upper and lower channels. The upper assembly may define a top opening of the continuous channel. The lower assembly may define a bottom opening of the continuous channel. The channel assembly may be configured to hold a bulk instance of the compressible material extending continuously through both the upper channel and the lower channel. The apparatus may include a gas source fixed in relation to the rotatable assembly. The gas source may be configured to supply a first gas through the top opening of at least one channel assembly of the plurality of channel assemblies to compress the bulk instance held within the at least one channel assembly based on rotation of the rotatable assembly to move the at least one channel assembly to a first position, such that the bulk instance in the at least one channel assembly includes an upper material portion in the upper channel of the at least one channel assembly and a lower material portion in the lower channel of the at least one channel assembly. The apparatus may include a cutting assembly configured to move in relation to the plurality of channel assemblies to extend transversely through a continuous channel of one channel assembly of the plurality of channel assemblies based on rotation of the rotatable assembly to move the one channel assembly to a second position, such that the lower material portion in the one channel assembly is severed from the upper material portion in the one channel assembly to produce the portioned instance, and the cutting assembly isolates the lower channel of the one channel assembly from the upper channel of the one channel assembly. The apparatus may include a discharge assembly fixed in relation to the rotatable assembly. The discharge assembly may be configured to supply a second gas into a lower channel of the one channel assembly of the plurality of channel assemblies to discharge the portioned instance through the bottom opening of the one channel assembly based on directing the second gas through a conduit assembly of the lower assembly of the one channel assembly to impinge on a lower face of the cutting assembly in the lower channel of the conduit assembly in response to rotation of the rotatable assembly to move the one channel assembly to a third position.

The cutting assembly may be fixed in relation to the plurality of channel assemblies, such that the cutting assembly is configured to extend transversely through the continuous channel of the one channel assembly based on the rotatable assembly rotating to move the one channel assembly to the second position.

The conduit assembly of each channel assembly of the plurality of channel assemblies may include an annular conduit assembly defining an annular conduit surrounding the lower channel of the channel assembly, the annular conduit assembly configured to direct the second gas from the discharge assembly into the annular conduit, and one or more bridging conduit assemblies defining one or more bridging conduits extending between the annular conduit assembly and a top end of the lower inner surface of the channel assembly, the one or more bridging conduit assemblies configured to direct the second gas from the annular conduit to a top portion of the lower channel of the channel assembly.

The lower assembly of each channel assembly of the plurality of channel assemblies may include a plurality of bridging conduit assemblies between the annular conduit assembly of the channel assembly and the top end of the lower inner surface of the channel assembly, the plurality of bridging conduit assemblies including the one or more bridging conduit assemblies of the channel assembly. The plurality of bridging conduit assemblies may be spaced apart equidistantly around a circumference of the lower inner surface of the channel assembly.

The gas source may be configured to supply the first gas to the plurality of channel assemblies at a positive pressure that exceeds an absolute pressure of an ambient environment surrounding the apparatus.

The apparatus may include a weight sensor configured to generate sensor data indicating a weight of portioned instances discharged through the bottom openings of the plurality of channel assemblies. The apparatus may include a control device communicatively coupled to the gas source and the weight sensor, the control device configured to adjustably control a pressure of the first gas supplied to the plurality of channel assemblies based on processing the sensor data, such that a weight of subsequently-provided portioned instances is maintained within a particular range.

The first gas and the second gas may be a common gas.

Each continuous channel may be a cylindrical channel.

According to some example embodiments, a method for operating an apparatus may include inserting compressible material into a continuous channel of a channel assembly, the channel assembly including an upper assembly defining an upper channel of the continuous channel and a lower assembly defining a lower channel of the continuous channel, such that the inserted compressible material defines a bulk instance of the compressible material extending continuously through the upper channel and the lower channel. The method may include controlling a gas source to supply a first gas through a top opening of the channel assembly to compress the bulk instance, such that an upper material portion of the bulk instance is in the upper channel, and a lower material portion of the bulk instance is in the lower channel. The method may include controlling a cutting assembly to extend transversely through the continuous channel to isolate the lower channel from the upper channel, such that the lower material portion is severed from the upper material portion to produce a portioned instance of the compressible material. The method may include controlling a discharge assembly to supply a second gas into the lower channel to discharge the portioned instance through a bottom opening of the channel assembly based on directing the second gas through a conduit assembly of the lower assembly to impinge on a lower face of the cutting assembly in the lower channel.

The channel assembly may be configured to move, the gas source may be fixed in relation to the channel assembly, and the controlling the gas source to supply the first gas into the continuous channel may include moving the channel assembly to a first position to be in fluid communication with the gas source.

The gas source may be configured to supply a continuous supply of the first gas.

The channel assembly may be configured to move, the cutting assembly may be fixed in relation to the channel assembly, controlling the cutting assembly to extend transversely through the continuous channel may include moving the channel assembly to a second position, and actuating the cutting assembly to extend transversely through the continuous channel in response to the channel assembly being at the second position.

The channel assembly may be configured to move, the discharge assembly may be fixed in relation to the channel assembly, and controlling the discharge assembly to supply the second gas into the lower channel may include moving the channel assembly to a third position to be in fluid communication with the discharge assembly, and controlling the discharge assembly in response to the channel assembly being at the third position.

The apparatus may include a rotatable assembly configured to rotate around a central longitudinal axis. The rotatable assembly may include a plurality of channel assemblies. The plurality of channel assemblies may be spaced apart around a circumference of the rotatable assembly. The plurality of channel assemblies may include the channel assembly. The gas source, the cutting assembly, and the discharge assembly may be fixed in relation to the rotatable assembly. Controlling the gas source to supply the first gas into the continuous channel may include rotating the rotatable assembly to move the channel assembly to a first position to be in fluid communication with the gas source. Controlling the cutting assembly to extend transversely through the continuous channel may include rotating the rotatable assembly to move the channel assembly to a second position, and actuating the cutting assembly to extend transversely through the continuous channel in response to the channel assembly being at the second position. Controlling the discharge assembly to supply the second gas into the lower channel may include rotating the rotatable assembly to move the channel assembly to a third position to be in fluid communication with the discharge assembly, and controlling the discharge assembly in response to the channel assembly being at the third position.

The first position, the second position, and the third position may be different from each other.

The gas source may be configured to supply a continuous supply of the first gas to at least a portion of the plurality of channel assemblies. Controlling the gas source to supply the first gas into the continuous channel may include rotating the rotatable assembly to move the channel assembly to the first position to initiate the supply of the first gas to the channel assembly. The method may further include rotating the rotatable assembly to move the channel assembly away from the first position to inhibit the supply of the first gas to the channel assembly.

The conduit assembly of the lower assembly may include an annular conduit assembly defining an annular conduit surrounding the lower channel, the annular conduit assembly configured to direct the second gas from the discharge assembly into the annular conduit. The conduit assembly may include one or more bridging conduit assemblies defining one or more bridging conduits extending between the annular conduit assembly and a top end of a lower inner surface of the lower assembly, the one or more bridging conduit assemblies configured to direct the second gas from the annular conduit to a top portion of the lower channel.

The lower assembly may include a plurality of bridging conduit assemblies between the annular conduit assembly and the top end of the lower inner surface, the plurality of bridging conduit assemblies including the one or more bridging conduit assemblies. The plurality of bridging conduit assemblies may be spaced apart equidistantly around a circumference of the lower inner surface.

Controlling the gas source to supply the first gas into the continuous channel may include supplying the first gas to the channel assembly at a positive pressure that exceeds an absolute pressure of an ambient environment surrounding the apparatus.

The continuous channel may be a cylindrical channel.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION OF EXAMPLE EMBODIMENTS

Figure 1A:
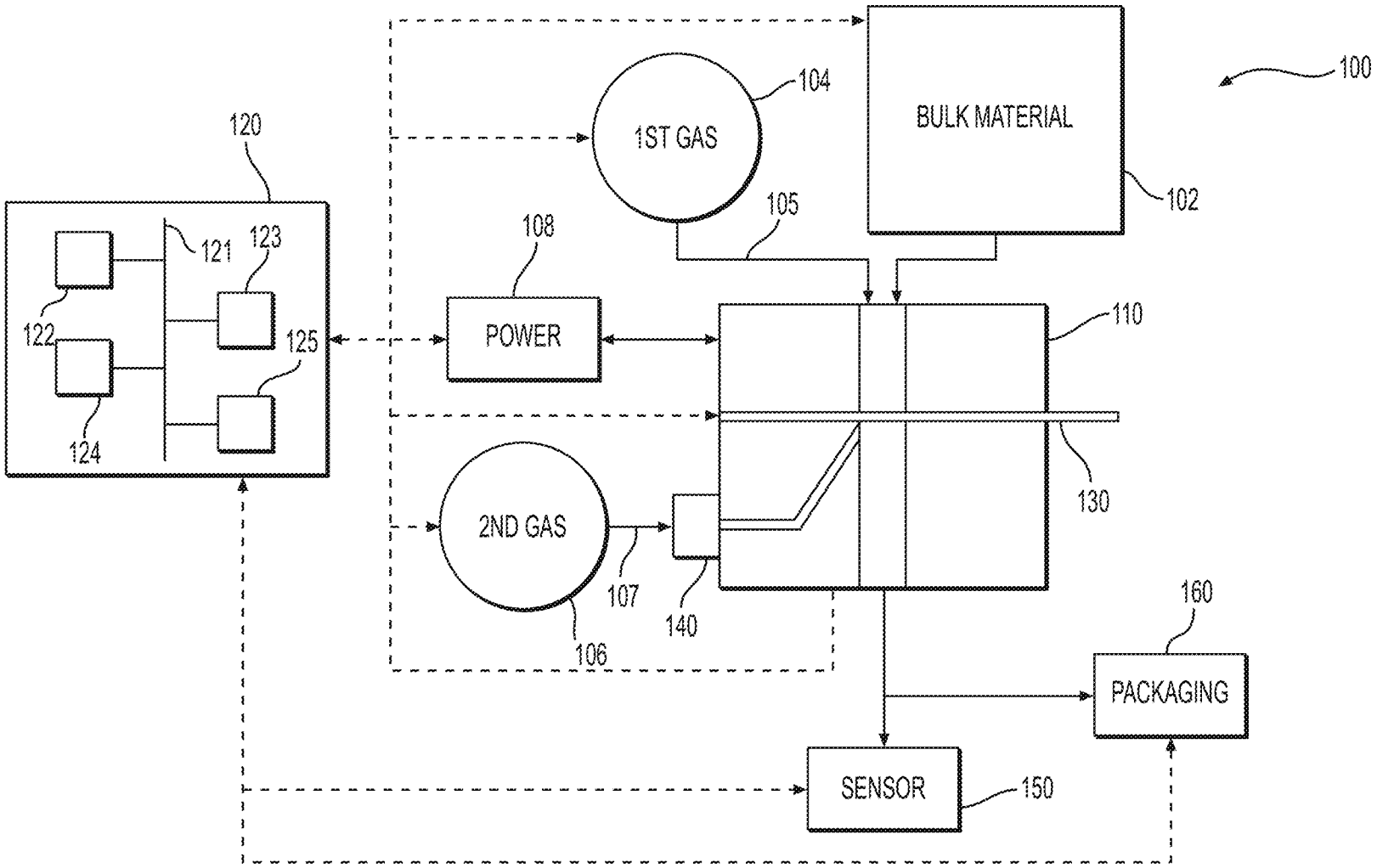
FIG. 1A is a schematic diagram view of an apparatus that includes a channel assembly, according to some example embodiments.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

When the terms "about" or "substantially" are used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages. The expression "up to" includes amounts of zero to the expressed upper limit and all values therebetween. When ranges are specified, the range includes all values therebetween such as increments of 0.1%. Moreover, when the words "generally" and "substantially" are used in connection with geometric shapes, it is intended that precision of the geometric shape is not required but that latitude for the shape is within the scope of the disclosure. Although channels and/or conduits described herein may be illustrated and/or described as being cylindrical, other channel and/or conduit cross-sectional forms are contemplated, such as square, rectangular, oval, triangular and others.

Figure 1B:
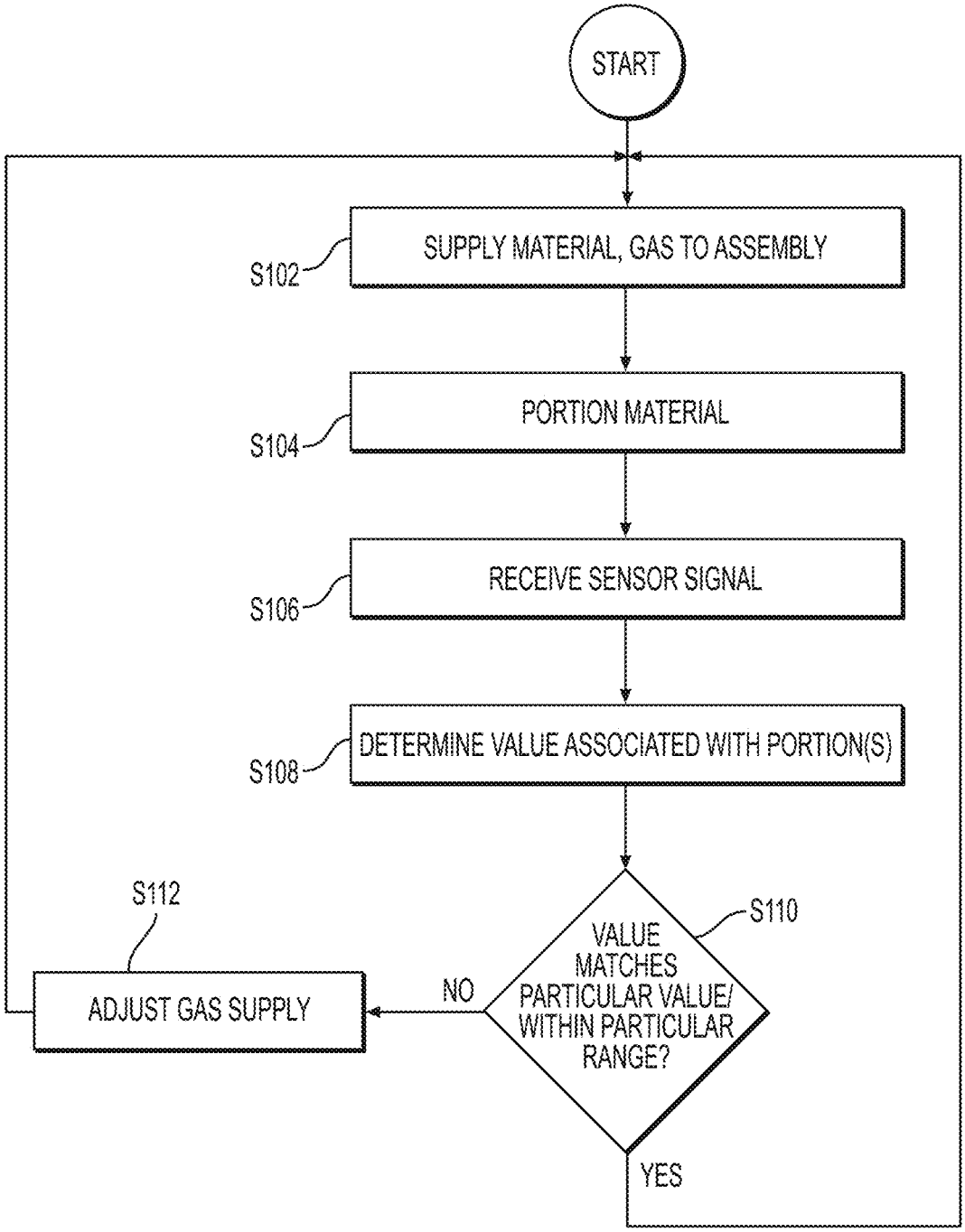
FIG. 1B is a flowchart illustrating operations that may be performed with regard to an apparatus, according to some example embodiments.

FIG. 1A is a schematic diagram view of an apparatus 100 that includes a channel assembly 110, according to some example embodiments. FIG. 1B is a flowchart illustrating operations that may be performed with regard to an apparatus, according to some example embodiments. The operations shown in FIG. 1B may be implemented with regard to the apparatus 100 shown in FIG. 1A, in some example embodiments. One or more of the operations shown in FIG. 1B may be implemented by one or more elements of apparatus 100 shown in FIG. 1A, including some or all of control device 120 and/or one or more elements based on control signals received from control device 120.

In some example embodiments, including the example embodiments shown in FIG. 1A, an apparatus 100 includes a material supply source 102, a gas source 104 (also referred to herein interchangeably as a "first gas source"), a power supply 108, a gas source 106 (also referred to herein interchangeably as a "second gas source"), a channel assembly 110, a control device 120, a cutting assembly 130, a discharge assembly 140, a sensor device 150, and a packaging assembly 160. In some example embodiments, gas source 106 is absent from apparatus 100.

The apparatus 100 may be configured to provide ("produce," "manufacture," "fabricate," etc.) portioned instances of a compressible material that is initially held in the material supply source 102 based on controlling the channel assembly 110 and the cutting assembly 130 to implement segmenting ("portioning," "severing," etc.) of a bulk instance of the compressible material, supplied into the channel assembly 110 from the material supply source 102, into one or more portioned instances of the compressible material. The apparatus 100 may provide said portioned instances to the packaging assembly 160 to be packaged, individually or in groups, to be provided as an end product.

As described further herein, the channel assembly 110 may include upper and lower assemblies that collectively define a continuous channel extending through the channel assembly 110, and the compressible material may be supplied from the material supply source 102 into the continuous channel of the channel assembly 110. As described herein, compressible material supplied ("inserted") into the channel assembly 110 may be referred to as a "bulk instance" of the compressible material.

The gas source 104 may supply a first gas 105 (e.g., via a first flow conduit as represented by the line representation of the first gas 105 in FIG. 1A) to the channel assembly 110 to compress the bulk instance in the channel assembly 110. The first gas 105 may be supplied at a pressure ("positive pressure") that exceeds the ambient pressure of the ambient environment surrounding the apparatus 100. For example, the gas source 104 may be configured to supply the first gas 105 to the channel assembly 110 at a pressure of about 10 psig. The first gas 105 may be supplied through an upper portion of the upper assembly of the channel assembly 110 and thus may compress the bulk instance of compressible material in the channel assembly 110 to cause the bulk instance to have a new density. The gas source 104 may control the flow ("flow rate," "flow velocity," some combination thereof, or the like) of the first gas 105. For example, the gas source 104 may include a gas flow control valve that is configured to be controlled (e.g., by control device 120) to adjust, inhibit, initiate, etc. the flow of the first gas 105 supplied by the gas source 104.

The channel assembly 110 may segment the bulk instance of compressible material into one or more portioned instances. The gas source 106 may supply ("provide") a second gas 107 to the channel assembly 110 (e.g., via a second flow conduit as represented by the line representation of the second gas 107 in FIG. 1A) via discharge assembly 140 to cause the one or more portioned instances to be discharged from the channel assembly 110. Thus, the gas source 106 may be understood to be configured to supply the second gas 107 to the channel assembly 110 via discharge assembly 140 to discharge the one or more portions instances from the channel assembly 110. The gas source 106 may control the flow ("flow rate," "flow velocity," some combination thereof, or the like) of the second gas 107. For example, the gas source 106 may include a gas flow control valve that is configured to be controlled (e.g., by control device 120) to adjust, inhibit, initiate, etc. the flow of the second gas 107 supplied by the gas source 104. The discharge assembly 140 may include an interface configured to couple with the gas source 106 (e.g., via a flow conduit) and may include an interface configured to couple with an inlet of the channel assembly 110. It will be understood that the discharge assembly 140 as shown in FIG. 1A may include any of the discharge assemblies described herein, including any embodiments of the discharge assembly 240 illustrated and described with reference to at least FIGS. 2-3 and 5A-5D and the discharge assembly 740 illustrated and described with reference to at least FIGS. 7-14.

In some example embodiments, the gas sources 104 and 106 (sometimes referred to as "first" and "second" gas sources, respectively) are the same gas source (a common gas source) configured to supply a common gas, via separate flow conduits (e.g., the aforementioned first and second flow conduits) and/or separate gas flow control valves, to compress the bulk instance and to discharge the one or more portioned instances, respectively. The first and second gases may be supplied, by a common gas source and/or different gas sources, to the channel assembly 110 at a common pressure or at different pressures. The first and second gases, as described herein, may be any gas, including air. In some example embodiments, including example embodiments where the gas source 104 and the gas source 106 are different gas sources, the first and second gasses may be different gases.

The power supply 108 may be a device configured to supply electrical and/or mechanical power to one or more portions of the apparatus 100, including one or more portions of the channel assembly 110, to cause the apparatus 100 to function. For example, the power supply 108 may supply power to control the supply of first and second gases to the channel assembly 110, control movement of one or more portions of the channel assembly 110, control movement of the cutting assembly 130, some combination thereof, or the like. In some example embodiments, the power supply 108 may be an electrical motor (e.g., an AC electrical motor).

In some example embodiments, one or more characteristics of the portioned instances to be packaged may be controlled in order to provide a packaged product having one or more relatively consistent characteristics. For example, in some example embodiments, at least a portion of the apparatus 100 (e.g., the control device 120) may be configured to control the density, weight, and/or volume of portioned and packaged instances of a material in order to ensure that each package of portioned material includes an approximately common mass, volume, density, and/or shape of material, thereby providing a relatively consistent end product to consumers.

In some example embodiments, based on the material to be portioned for packaging of the individual portioned instances thereof being a compressible material, at least the density and/or weight of the individual portioned instances of the material may be at least partially controlled (e.g., by at least a portion of apparatus 100, including control device 120) based on compressing a bulk instance of the material within the channel assembly 110 to achieve a particular density of the bulk instance and then segmenting the compressed bulk instance into multiple portions, such that each portioned instance may have a relatively common density that is at least approximately the particular density.

The control device 120 may be communicatively coupled to some or all of the elements of the apparatus 100, as shown in FIG. 1A. The control device 120 may be configured to control some or all of the elements of the apparatus 100 to control the production and provision of portioned instances by the channel assembly 110.

As shown in FIG. 1A, the control device 120 may include a processor 122, a memory 123, a control interface 124, and a communication interface 125, electrically coupled via a common bus 121. The memory 123 may be a non-transitory computer-readable storage medium. The memory 123 may store one or more programs of instruction, and the processor 122 may execute the one or more programs of instruction to implement one or more functions, including controlling one or more portions of the apparatus 100 and/or causing the apparatus 100 to perform one or more operations. Referring now to methods described herein, particularly with regard to one or more flowchart drawings described further herein, one or more operations of said methods may be implemented by the control device 120 based at least on the processor 122 executing one or more programs of instruction stored in the memory 123. The processor 122 may generate one or more control signals to control one or more elements of apparatus 100 based on executing the one or more programs of instruction.

The control interface 124 may be configured to receive control commands, including commands provided by an operator based on manual interaction with the control interface. The control interface 124 may be a manual interface, including a touchscreen display interface, a button interface, a mouse interface, a keyboard interface, some combination thereof, or the like. Control commands received at the control interface 124 may be forwarded to processor 122 via the bus 121, and the processor 122 may execute one or more programs of instruction, for example to adjust operation of one or more portions of the apparatus 100, based on the control commands.

The communication interface 125 is communicatively coupled to one or more of the elements of apparatus 100, for example as shown by the dashed-line elements in FIG. 1A. The communication interface 125 may be communicatively coupled to an element via one or more of a wired electrical connection (e.g., a communication wire and/or circuitry), a wireless network connection, some combination thereof, or the like. The communication interface 125 may receive data generated by one or more of the elements and forward said data to the processor 122, via bus 121, for processing. The communication interface 125 may transmit control signals to one or more of the elements of apparatus 100, based on operation of the processor 122, to cause the one or more elements to operate as controlled by the processor 122.

Sensor device 150 is configured to generate data signals (also referred to herein as simply "sensor data") based on monitoring one or more aspects of a portioned instance of the compressible material that is discharged by the channel assembly 110. In some example embodiments, the sensor device 150 is a weight scale device that is configured to generate data signals associated with a weight of a portioned instance based on the portioned instance interacting with a sensing element of the sensor device 150. The data signals may be communicated to control device 120 via communication interface 125, and the processor 122 may process the data signals to determine a weight of the portioned instance.

In some example embodiments, the control device 120 (e.g., the processor executing a program of instructions) may be configured to determine one or more characteristics of a portioned instances based on an instance of sensor data received from the sensor device 150. For example, the memory 123 may store information indicating a volume of portioned instances, and the processor 122 may be configured to determine a density of a portioned instance based on the stored volume and further based on processing sensor data received from sensor device 150 to determine a weight and/or mass of the portioned instance.

Referring now to FIG. 1B, in some example embodiments, the control device 120 may monitor one or more aspects ("characteristics," "properties," etc.) of one or more portioned instances discharged by the channel assembly 110 and may responsively adjust one or more elements of the apparatus 100 to control the one or more aspects to be within a particular range of values or to match a particular value.

At S102, the control device 120 may control the material supply source 102 (e.g., based on generating control signals that, when received at the material supply source 102, cause a supply valve, pump, conveyer device, etc., to actuate to control a flow of compressible material from the material supply source 102) to cause the material supply source 102 to supply compressible material to the channel assembly 110.

At S104, the control device 120 may control one or more elements of the apparatus 100 (e.g., the gas source 104, the power supply 108, the cutting assembly 130, the gas source 106, some combination thereof, or the like) to cause one or more portioned instances of the compressible material to be produced at the channel assembly 110. Such an operation is described further below with reference to FIGS. 4 and FIGS. 5A-5D.

At S106, the control device 120 may receive sensor data ("data signals") from the sensor device 150 based on the produced one or more portioned instances interacting with a sensing element of the sensor device 150 and the sensor device 150 responsively generating one or more data signals that are communicated to the control device 120. In some example embodiments, the sensor device 150 may be a weight sensor (e.g., a weight scale) configured to generate data signals associated with the weight of a portioned instance interacting with a sensing element of the weight sensor.

At S108, the control device 120 may process the received sensor data to determine a value associated with one or more particular aspects ("characteristics," "properties," etc.) of the produced one or more portioned instances. For example, where the sensor device 150 generating the sensor data is a weight sensor, the control device 120 may process the received sensor data to determine a weight ("mass") value associated with the produced one or more portioned instances. In another example, for example where the control device 120 stores data indicating a predicted volume of produced portioned instances, the control device 120 may process the received sensor data (associated with weight values) to determine a density value associated with the produced one or more portioned instances.

A value determined based on processing sensor data received from sensor device 150 may be an arithmetic value (e.g., a mean value, a median value, or the like) associated with one or more particular aspects associated with a set or range of discharged portioned instances (e.g., the last 10 produced portioned instances, the portioned instances produces within the last 30 minutes, etc.) For example, the control device 120 may maintain and continuously update a running mean weight of the last 20 portioned instances produced by channel assembly 110. The control device 120 may update the running mean weight based on processing received sensor data from sensor device 150 to determine a weight of a most recently-produced portioned instance and updating the running mean weight value based on the determined weight.

At S110, the control device 120 may compare the value determined at S108 (e.g., an arithmetic value) to a particular (or, alternatively, predetermined) value or range of values to determine whether the arithmetic value matches the particular value or is within the range of values. The particular value or range of values may be stored at the control device 120 (e.g., in memory 123). If so, the process as shown in FIG. 1B may repeat. If not, as shown at S112, the control device 120 may control one or more elements of the apparatus 100 to cause the one or more aspects of subsequently-produced portioned instances to match the particular value or be within the range of values. For example, based on the control device 120 determining that the mean weight of the ten most recently-produced portioned instances is less than the values in a particular range of weight values, the control device 120 may determine that the density of the portioned instances is too low and thus may control the gas source 104 to increase the pressure of the first gas 105 supplied to the channel assembly 110, thereby increasing the compression of the bulk instance held in the channel assembly 110 and thus causing the density of the bulk instance and the portioned instances to increase as well.

As a result, the apparatus 100 may be configured to rapidly adjust one or more elements thereof (e.g., the supply of first gas 105) to rapidly adjust one or more characteristics (e.g., density) of produced portioned instances without requiring complicated adjustments to the apparatus 100. Furthermore, because the operations shown in FIG. 1B may be performed without taking apparatus 100 offline, the adjustments may be performed without slowing or stopping the production of portioned instances. Thus, the apparatus 100 may be configured to produce portioned instances of compressible material that have one or more desired aspects with improved efficiency and with reduced costs.

Figure 2:
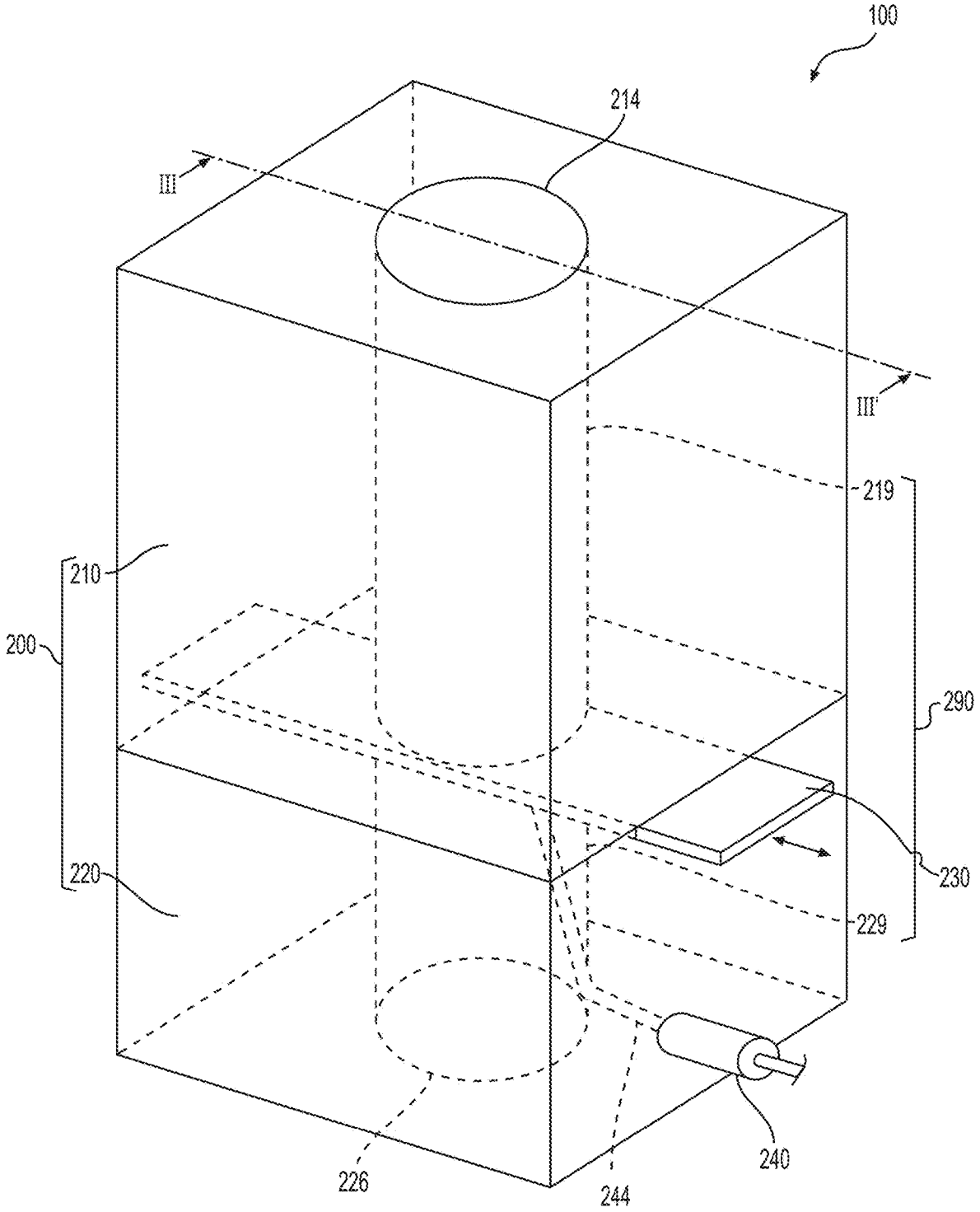
FIG. 2 is a perspective view of an apparatus that includes a channel assembly and a cutting assembly, according to some example embodiments.
Figure 3:
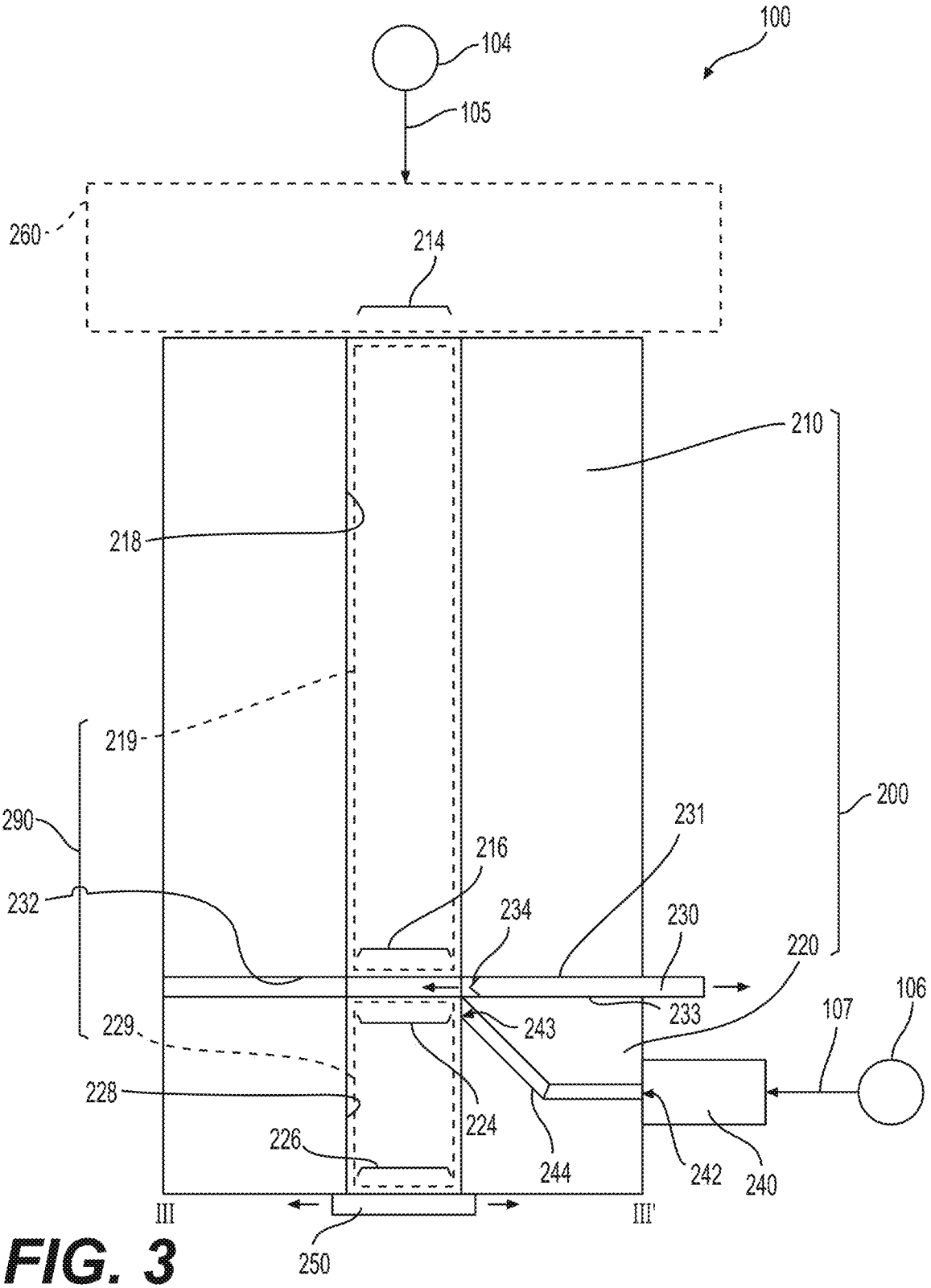
FIG. 3 is a side cross-sectional view along line III-III' of the channel assembly and cutting assembly of FIG. 2.

FIG. 2 is a perspective view of an apparatus 100 including a channel assembly 200 and cutting assembly 230, according to some example embodiments. FIG. 3 is a side cross-sectional view along line III-III' of the channel assembly 200 of FIG. 2. The channel assembly 200 may be included in, and/or may be, the channel assembly 110 of apparatus 100 as shown in FIG. 1A. The cutting assembly 230 may be included in, and/or may be, the cutting assembly 130 of apparatus 100 as shown in FIG. 1A.

In some example embodiments, an apparatus 100 includes a channel assembly that includes an upper assembly and a lower assembly, where the upper assembly includes an upper inner surface defining an upper channel, the lower assembly includes a lower inner surface defining a lower channel, the upper inner surface and the lower inner surface collectively at least partially define a continuous channel including the upper and lower channels, the upper assembly defines a top opening of the continuous channel, and the lower assembly defines a bottom opening of the continuous channel. For example, as shown in FIGS. 2-3, channel assembly 200 includes an upper assembly 210 and a lower assembly 220. Upper assembly 210 includes an upper inner surface 218 defining an upper channel 219, and lower assembly 220 includes a lower inner surface 228 defining a lower channel 229. As shown in FIGS. 2-3, the upper inner surface 218 and the lower inner surface 228 collectively at least partially define a continuous channel 290 that includes the upper channel 219 and the lower channel 229.

As further shown in FIGS. 2-3, the upper assembly 210 defines a top opening 214 and a bottom opening 216 of the upper channel 219, and the lower assembly 220 defines a top opening 224 and a bottom opening 226 of the lower channel 229. The bottom opening 216 and top opening 224 are proximate to and in fluid communication with each other, such that the upper channel 219 and the lower channel 229 are in continuous fluid communication with each other and thus collectively at least partially define a continuous channel 290. The top opening 214 defines a top opening of the continuous channel 290, and thus the upper assembly 210 defines top opening 214 as the top opening of the continuous channel 290. The bottom opening 226 defines a bottom opening of the continuous channel 290, and thus the lower assembly 220 defines a bottom opening of the continuous channel 290.

In some example embodiments, including the example embodiments shown in FIGS. 2-3, and as further shown in FIGS. 5A-5D, described further below, a channel assembly may be configured to hold a bulk instance of a compressible material extending continuously through both the upper channel and the lower channel. For example, as shown in at least FIGS. 5A-5D, the channel assembly 200 may hold a bulk instance of a compressible material that extends continuously through the continuous channel 290 to thus extend continuously through both the upper channel 219 and the lower channel 229.

Referring back to FIGS. 2-3, in some example embodiments, a gas source may be configured to supply a first gas through the top opening of a continuous channel to compress a bulk instance held within the continuous channel, such that the bulk instance includes an upper material portion in the upper channel and a lower material portion in the lower channel. For example, as shown in FIGS. 2-3, and with reference to FIG. 1A, apparatus 100 may include a gas source 104 that may be configured to supply a first gas 105 through the top opening 214 of the continuous channel 290 to compress a bulk instance held within the continuous channel 290. A portion of the compressed bulk instance held in the lower channel 229 may be referred to as a lower material portion, and a portion of the compressed bulk instance held in the upper channel 219 may be referred to as an upper material portion.

As shown in FIGS. 2-3, an apparatus 100 may include an enclosure 260 that is in fluid communication with both the top opening 214 and the gas source 104. The enclosure may be at least partially defined by one or more surfaces, including a top surface of the upper assembly 210 as shown in at least FIG. 3. The gas source 104 may supply the first gas 105 into the enclosure 260 to pressurize the enclosure 260 with the first gas 105. As a result, the first gas 105 may be supplied relatively uniformly into the continuous channel 290 of the channel assembly 200 from the enclosure 260 through the top opening 214. The first gas 105 may be supplied at a sufficient amount and pressure so as to cause the pressure of first gas 105 in at least the enclosure 260 and the upper channel 219, and thus applied to an upper surface of the bulk instance of compressible material held in the continuous channel 290, to exceed an ambient pressure of an ambient environment as described herein. Based on providing a relatively uniform flow of pressurized first gas 105 through the top opening 214 and downwards through at least the upper channel 219, the apparatus 100 may compress a bulk instance of compressible material held in the continuous channel 290 through the application of pressurized first gas 105.

Still referring to FIGS. 2-3, an apparatus 100 may include a cutting assembly. The cutting assembly may be configured to move in relation to a channel assembly to extend transversely through the continuous channel between the upper channel and the lower channel of the channel assembly, such that the lower material portion is severed from the upper material portion to establish the lower material portion as the portioned instance, and the cutting assembly isolates the lower channel from the upper channel. The severing of the lower material portion from the upper material portion may also be referred to herein as "producing" the portioned instance of the compressible material.

As shown in FIGS. 2-3, a bottom surface of the upper assembly 210 and a top surface of the lower assembly 220 collectively define a transverse conduit 232 extending transversely, in relation to the continuous channel 290, between the upper assembly 210 and the lower assembly 220. As referred to herein, extending transversely ("transverse") to a channel includes extending transversely to a longitudinal axis of the channel. In the example embodiments shown in FIGS. 2-3, for example, the upper surface of the lower assembly 220 includes a recess that establishes the transverse conduit 232 between the recessed portion of the upper surface of the lower assembly 220 and a non-recessed lower surface of the upper assembly 210. It will be understood, however, that the transverse conduit 232 may be at least partially defined by a recessed portion of the lower surface of the upper assembly 210, in addition to or in alternative to a recessed portion of the upper surface of the lower assembly 220.

As further shown in FIGS. 2-3, apparatus 100 may include a cutting assembly 230. As further shown in FIGS. 2-3, the cutting assembly 230 is configured to adjustably extend through the transverse conduit 232 to move transversely in relation to (e.g., perpendicularly to) the longitudinal axis of the continuous channel 290. As shown in FIGS. 2-3, the cutting assembly 230 may extend ("move") transversely through the continuous channel 290, between the upper channel 219 and the lower channel 229. The cutting assembly 230 may further include an edge portion 234 that is configured to cut through any material that is located within the portion of the transverse conduit 232 that at least partially defines a portion of the continuous channel 290 between the upper channel 219 and the lower channel 229. It will be understood that the portion of the transverse conduit 232 that at least partially defines a portion of the continuous channel 290 may be considered to be a portion of a bottom end of the upper channel 219 and/or a portion of a top end of the lower channel 229.

In some example embodiments, including the example embodiments shown in FIGS. 2-3, as a result of the cutting assembly 230 extending transversely to the continuous channel 290, the cutting assembly 230 may isolate the lower channel 229 from the upper channel 219, such that an upper surface 231 of the cutting assembly 230 is in fluid communication with, and defines a bottom boundary of, the upper channel 219, and a lower surface 233 of the cutting assembly 230 is in fluid communication with, and defines a top boundary of, the lower channel 229.

In addition, where a bulk instance of compressed material extends through the upper channel 219 and the lower channel 229, and as a result of the cutting assembly 230 extending transversely to the continuous channel 290, the cutting assembly 230 may sever the lower material portion of the bulk instance (held in the lower channel 229) from the upper material portion of the bulk instance (held in the upper channel 219). For example, as noted above, the cutting assembly 230 may include an edge portion 234 that is configured to cut through the bulk instance of the compressed material based on the cutting assembly 230 moving transversely through the channel assembly 200 between the upper channel 219 and the lower channel 229.

The severed lower material portion may be referred to herein as a portioned instance of the compressible material. As a result, severing the lower material portion from the upper material portion may be referred to herein as producing the portioned instance of the compressible material, where the severed material portion is the portioned instance.

In some example embodiments, the apparatus 100 includes a discharge assembly configured to supply a second gas into the lower channel to discharge the portioned instance through the bottom opening based on directing the second gas through a conduit assembly of the lower assembly to impinge on a lower face of the cutting assembly in the lower channel.

For example, as shown in FIGS. 2-3, apparatus 100 may include a discharge assembly 240 and a conduit assembly 244. The conduit assembly 244 extends through an interior of the lower assembly 220 and thus may be considered to be a part of the lower assembly 220. Thus, the conduit assembly 244 may be referred to herein as a conduit assembly 244 of the lower assembly 220. The discharge assembly 240 is configured to receive a second gas 107 from the gas source 106 of the apparatus 100. As noted above with reference to FIG. 1A, in some example embodiments, the gas source 104 and the gas source 106 are a common gas source, such that the first gas 105 and the second gas 107 are both a common type of gas that is supplied, independently of each other in independent flow conduits, from a common source.

Still referring to FIGS. 2-3, the conduit assembly 244 extends from an opening ("inlet 242") in an outer surface of the lower assembly 220 and through the interior of the lower assembly 220 to an opening ("outlet 243") in the lower inner surface 228 at a location, at a top end of the lower inner surface 228, that is proximate to the top opening 224 of the lower channel 220. Thus, as the portion of the lower channel 229 that is proximate to the top opening 224 will be understood herein to be a top portion of the lower channel 229, it will further be understood that the conduit assembly 244 extends through the interior of the lower assembly 220 such that the outlet 243 of the conduit assembly 244, which is shown in FIGS. 2-3 to be in a top end of the lower inner surface 228, is in fluid communication with the top portion of the lower channel 229. As a result, the discharge assembly 240, shown in FIGS. 2-3 to be in fluid communication with inlet 242 of the conduit assembly 244, is configured to direct the second gas 107 received from the gas source 106 through the conduit assembly 244 and into the top portion of the lower channel 229.

As further shown in FIGS. 2-3, the conduit assembly 244 is oriented such that the outlet 243 of the conduit assembly 244 is directed towards the top opening 224 of the lower channel 229. Based on the cutting assembly 230 being in an extended position, such that the lower surface 233 of the cutting assembly 230 defines a top boundary of the lower channel 229 and isolates the lower channel 229 from the upper channel 219, the conduit assembly 244 is configured to direct the second gas 107 through the outlet 243 to impinge directly on to the lower surface 233 of the extended cutting assembly 230. Such an impinging flow of the second gas 107 on the lower surface 233 may be redirected by the lower surface 233 throughout the top portion of the lower channel 229, as described further below with reference to FIG. 5D. The increased pressure in the top portion of the lower channel 229 that is caused by the second gas 107 directed into the top portion of the lower channel 229 may induce a relatively uniform downwards pressure on a top portion of the portioned instance of compressible material held in the lower channel 229, thereby pushing the portioned instance downwards and through the bottom opening 226 to be discharged from the channel assembly 200.

Still referring to FIGS. 2-3, the apparatus 100 may include a sealing plate 250 that is configured to move to reversibly seal or expose the bottom opening 226 of the channel assembly 200. The sealing plate 250 may be connected to the channel assembly 200 (e.g., slidably as shown in FIG. 3, hingedly via a hinge, or the like). The sealing plate 250 may not be directly connected to the channel assembly 200 and may be configured (e.g., based on control by the control device 120 shown in FIG. 1A) to move in relation to the channel assembly 200 to reversibly seal or expose the bottom opening 226 of the channel assembly 200.

Based on the sealing plate 250 sealing the bottom opening 226, the sealing plate 250 may restrict any compressible material held in at least the lower channel 229 of the channel assembly 200 to remain within the channel assembly 200. For example, the sealing plate 250 may be in a closed position ("configuration"), as shown in at least FIG. 3, in order to preclude compressible material from being forced through the bottom opening 226 by the first gas 105 in response to first gas 105 being supplied through the top opening 214 to compress the bulk instance of compressible material within the continuous channel 290 of the channel assembly 200. In another example, the sealing plate 250 may be in an open position while second gas 107 is directed through the conduit assembly 244 of the discharge assembly 240 to discharge the portioned instance of the compressible material out of the channel assembly through the bottom opening 226.

The sealing plate 250 position ("configuration") may be at least partially controlled by a control device, including the control device 120 shown in FIG. 1A. In some example embodiments, including example embodiments described below in relation to at least FIGS. 7-14, the position of the sealing plate 250 in relation to the channel assembly 200 may be controlled based on controlling a position of the channel assembly in relation to the sealing plate 250.

Figure 4:
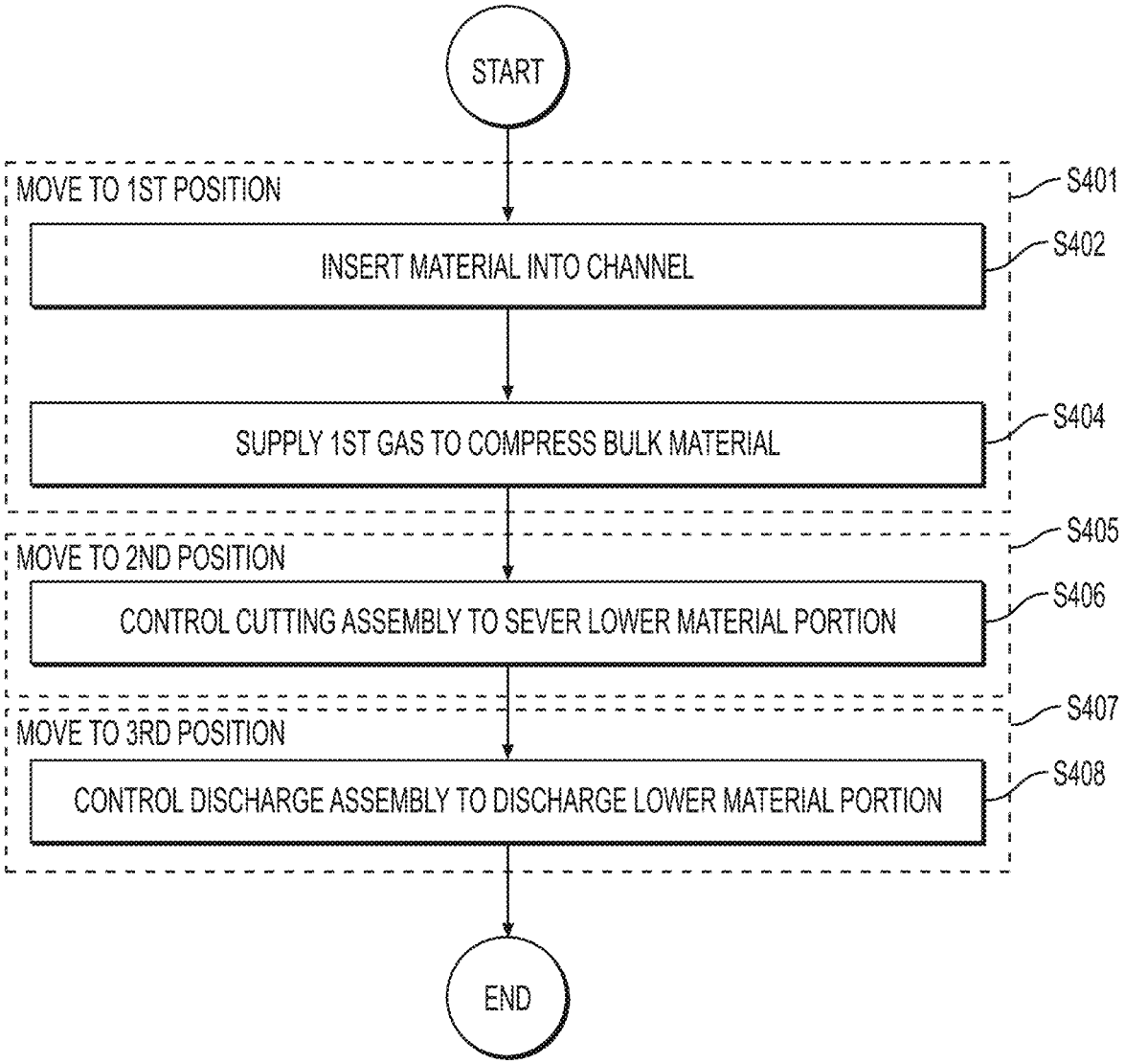
FIG. 4 is a flowchart illustrating operations that may be performed with regard to an apparatus that includes a channel assembly, according to some example embodiments.

FIG. 4 is a flowchart illustrating operations that may be performed with regard to an apparatus that includes a channel assembly, according to some example embodiments. FIGS. 5B, 5C, and 5D are side cross-sectional views along line III-III' of the apparatus of FIG. 2 that illustrate operations shown in the flowchart of FIG. 4, according to some example embodiments. One or more of the operations shown in FIG. 4 may be implemented by one or more elements of apparatus 100 shown in FIG. 1A, including some or all of control device 120 and/or one or more elements of apparatus 100 operating based on one or more control signals received from control device 120.

Figure 5A:
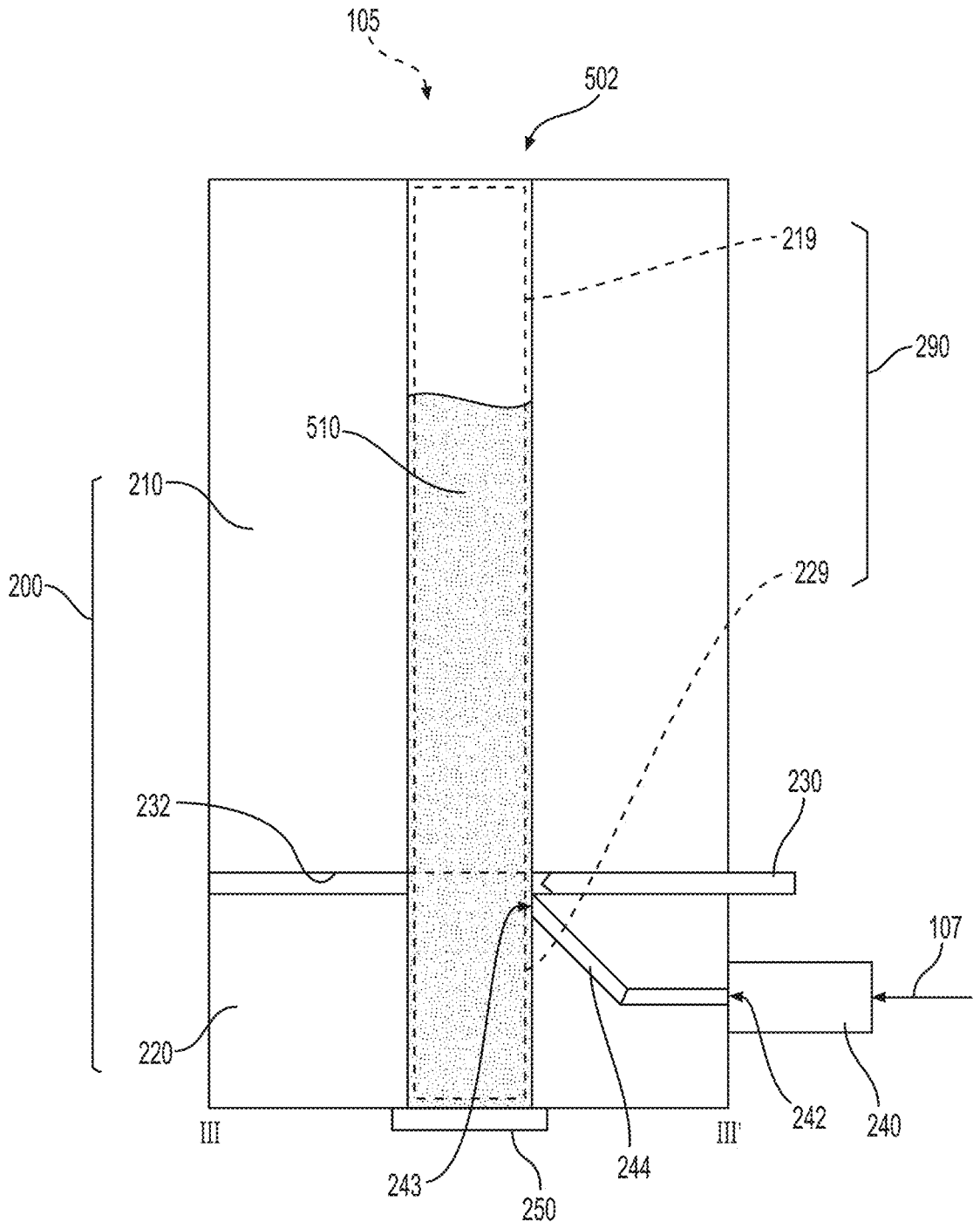
FIGS. 5A, 5B, 5C, and 5D are side cross-sectional views along line III-III' of the apparatus of FIG. 2 that illustrate operations shown in the flowchart of FIG. 4, according to some example embodiments.
Figure 5B:
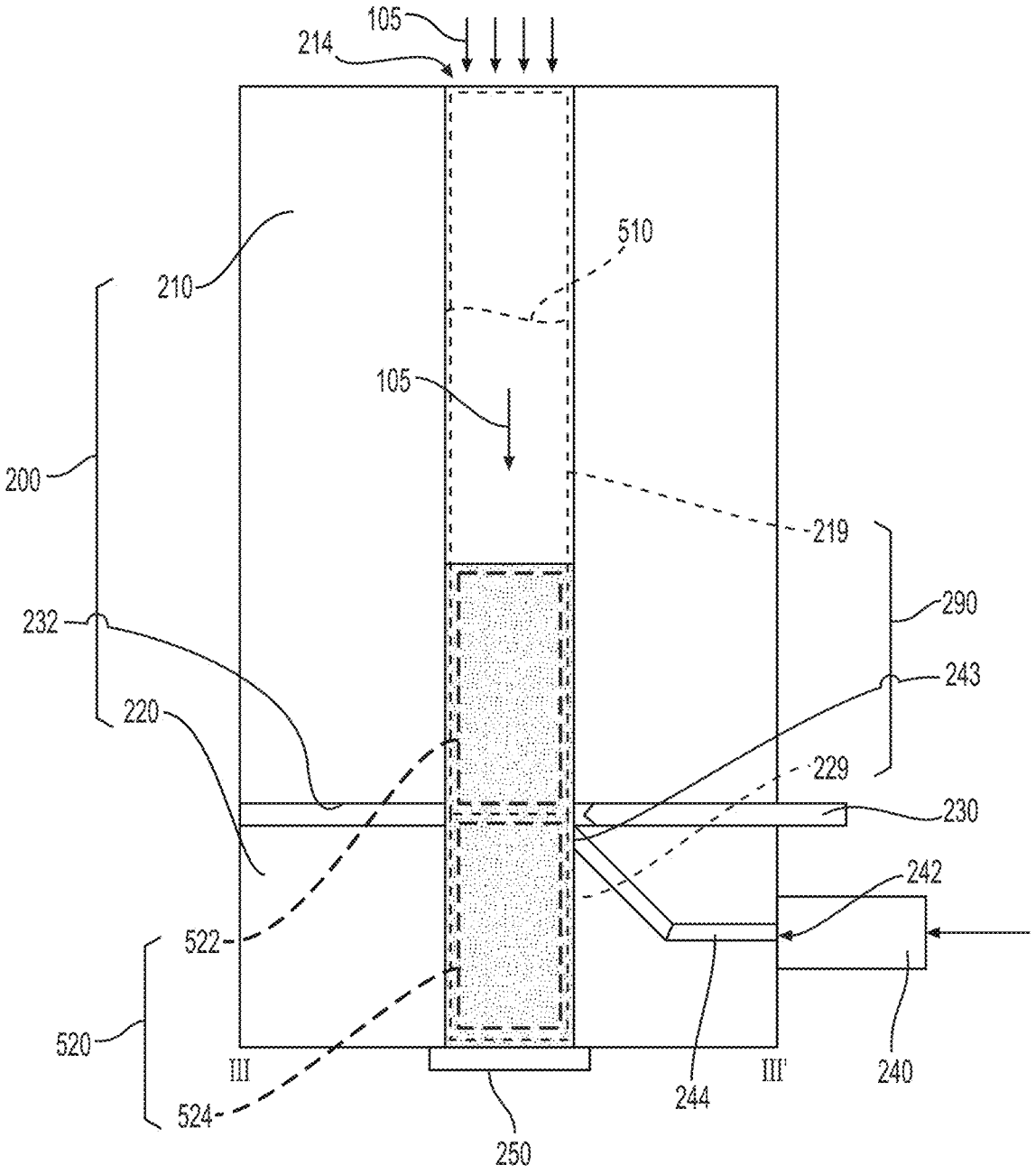
Figure 5C:
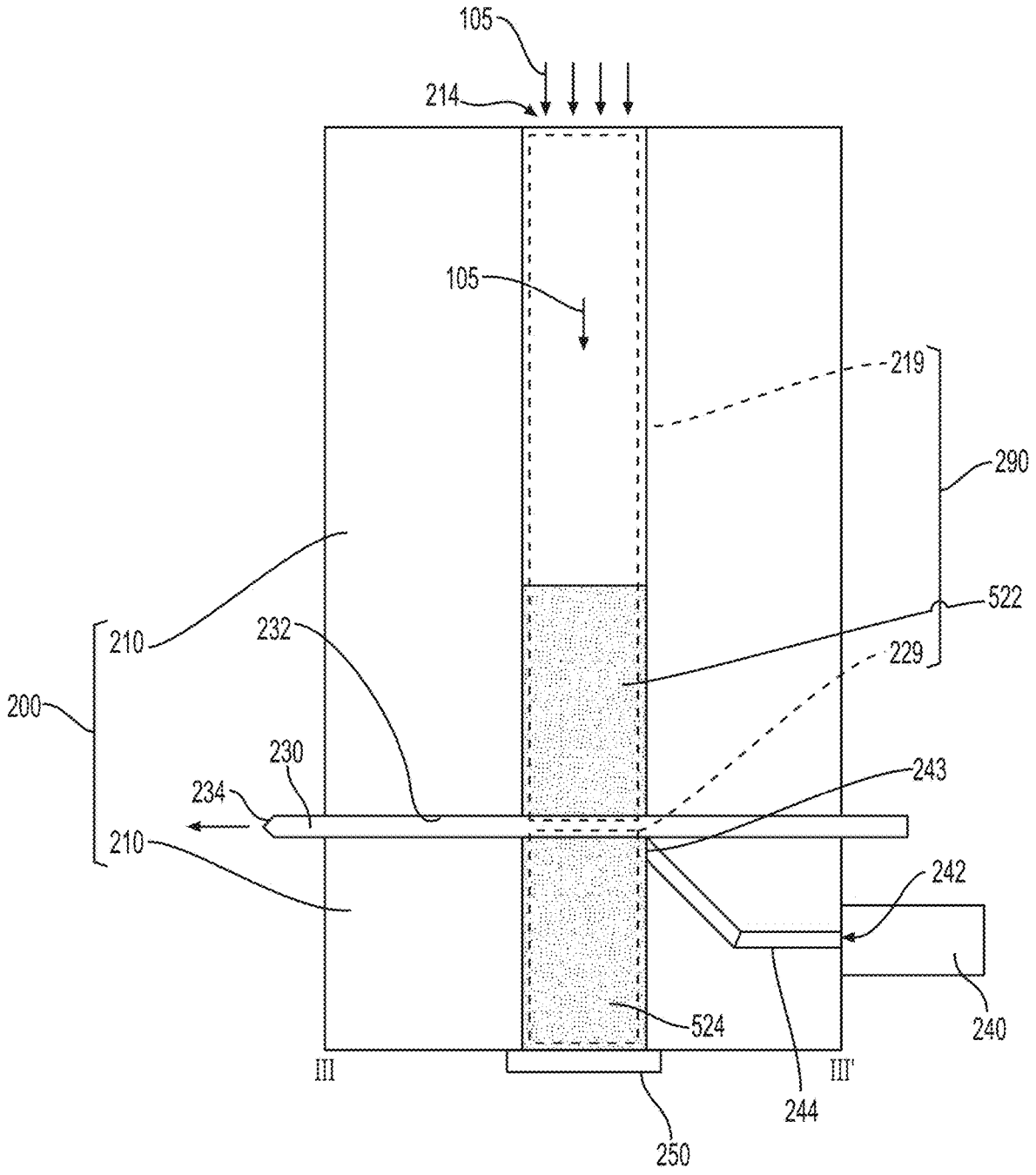
Figure 5D:
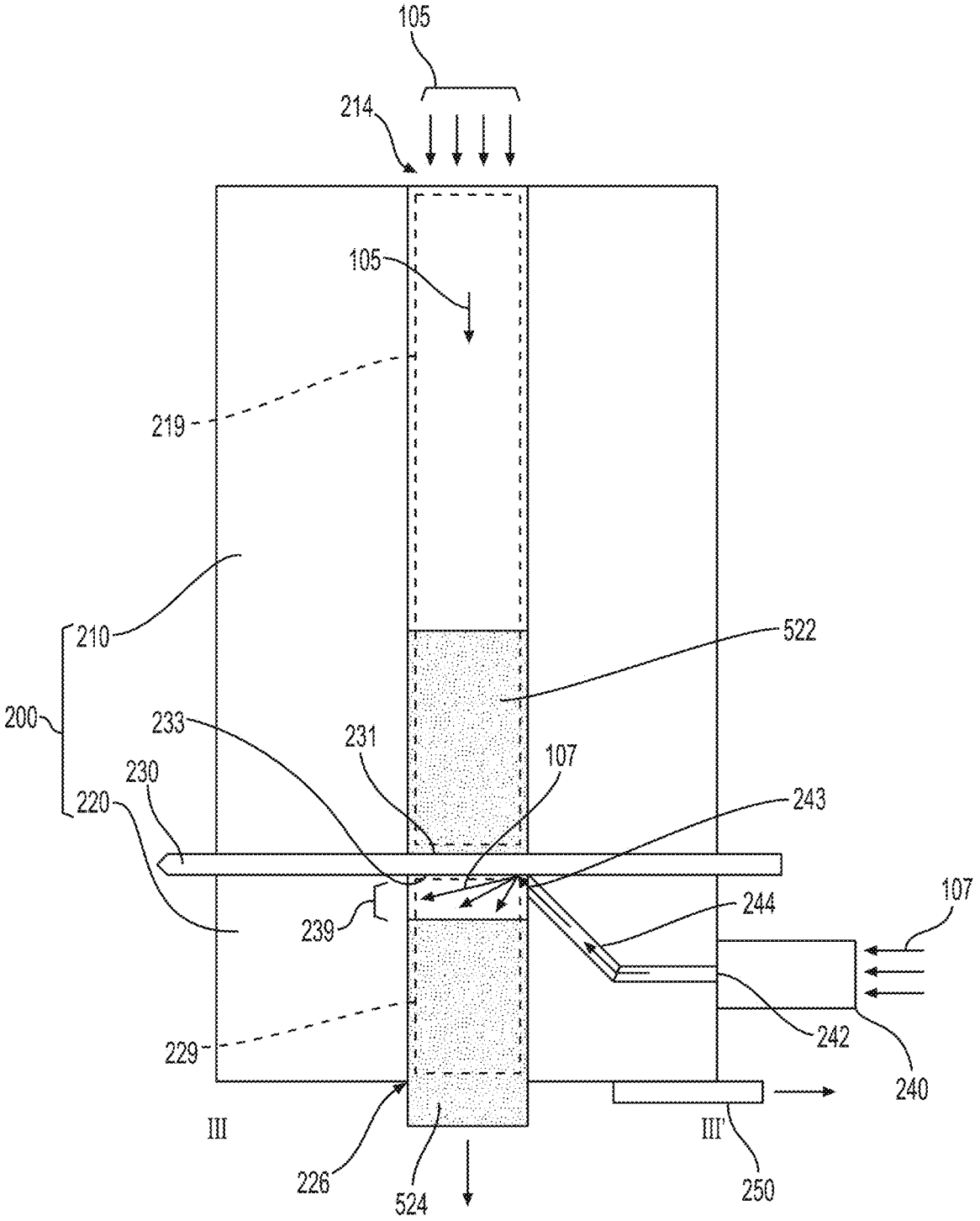

Referring first to FIGS. 4 and 5A, and as shown at operation S402 of FIG. 4, compressible material 502 may be introduced ("inserted") into the continuous channel 290 of the channel assembly 200, such that the inserted compressible material defines a bulk instance 510 of the compressible material that extends continuously through the upper channel 219 and the lower channel 229 of the continuous channel 290. The introduction of compressible material 502 at S402 may be implemented by control device 120 of apparatus 100, for example based on controlling one or more elements associated with the material supply source 102 (e.g., a control valve, conveyer assembly, or the like) to cause compressible material 502 to be supplied from the material supply source 102 to be introduced into the continuous channel 290 of the channel assembly 200.

As shown in FIG. 5A, the cutting assembly 230 may be in a retracted position ("configuration") such that the cutting assembly 230 does not extend into the continuous channel 290 and does not isolate any portion of the lower channel 229 from the upper channel 219. As further shown in FIG. 5A, the discharge assembly 240 may not direct second gas 107 through the conduit assembly 244 to the top portion of the lower channel 229. In some example embodiments, the discharge assembly 240 directs a relatively small flow of second gas 107 through the conduit assembly 244 during operation S402 to establish sufficient pressurization of the conduit assembly 244 to preclude any of the compressible material from entering the conduit assembly 244 from the continuous channel 290.

In some example embodiments, a supply of the first gas 105 to the channel assembly 200 is inhibited during the insertion of compressible material 502 into the continuous channel 290 at S402. In some example embodiments, including the example embodiments shown in FIG. 5A, the first gas 105 is controlled to at least partially drive the compressible material 502 into the continuous channel 290 through the top opening 214. For example, where the apparatus 100 includes the enclosure 260 as described above with reference to FIGS. 2-3, the compressible material 502 may be introduced into enclosure 260, and the first gas 105 may be supplied into the enclosure 260 to push the compressible material 502 into the continuous channel 290 via top opening 214. The inhibition may be implemented by control device 120 of apparatus 100, for example based on controlling one or more elements associated with the gas source (e.g., a control valve) to cause a supply of first gas 105 to the continuous channel 290 of the channel assembly 200 to be inhibited.

Referring now to FIGS. 4 and 5B, at S404 a gas source (e.g., the gas source 104 and/or a common gas source for the first gas 105 and the second gas 107) is controlled to supply the first gas 105 through the top opening 214 of the channel assembly 200 to compress the bulk instance 510 to establish a compressed bulk instance 520 of the compressible material. As shown in FIG. 5B, an upper material portion 522 of the bulk instance 520 is in the upper channel 219, and a lower material portion 524 of the bulk instance 520 is in the lower channel 229. The controlling of the gas source (e.g., the gas source 104 and/or a common gas source for the first gas 105 and the second gas 107) at S404 may be implemented by control device 120 of apparatus 100, for example based on controlling one or more elements associated with the gas source (e.g., a control valve) to cause the gas source to supply the first gas 105 through the top opening 214 of the channel assembly 200.

In some example embodiments, the first gas 105 is supplied (e.g., based on control of an element associated with a gas source by control device 120) at a pressure exceeding the ambient pressure surrounding the apparatus 100, such that the first gas 105 compresses the bulk instance 510 of compressible material to cause the density of the bulk instance 520 to be adjusted to a density that matches a particular density value or is within a particular range of density values. Additionally, the amount of compression (e.g., the force applied on the bulk instance 510 by the first gas 105 to achieve compression of the bulk instance 510) may be adjustably controlled (e.g., by control device 120) based on adjusting the supply of the first gas 105 to the continuous channel 290 via top opening 214 (for example, based on control device 120 controlling a gas supply valve associated with the gas source 104).

Based on utilizing the first gas 105 to achieve density adjustment of the compressible material through compression of the bulk instance 510, where the first gas 105 can be simply controlled (e.g., via control of a gas flow control valve of the gas source 104 by control device 120) to control the amount of compression and thus the resulting density of the compressed bulk instance 520, the apparatus 100 may be configured to enable relatively simplified compression and density control of the compressible material, thereby providing capital and operational savings due to reduced complexity, simplified operations, simplified adjustment operations, and mitigating a need to take the apparatus 100 off-line from operation in order to implement adjustments to the compression provided by the first gas 105. Regarding the supply of first gas 105, the utilization of moving parts may be restricted to the gas source 104 gas flow control valve that is used to control the supply of first gas 105 to the continuous channel 290, thereby representing a substantial reduction in the quantity and complexity of mechanical and/or hydraulic structures that would otherwise be used to achieve compression of the bulk instance 510.

Referring now to FIGS. 4 and 5C, at S406 a cutting assembly 230 is controlled (e.g., by control device 120) to extend transversely through the continuous channel 290, based on the cutting assembly extending through transverse conduit 232, to isolate the lower channel 229 from the upper channel 219, such that the lower material portion 524 is severed from the upper material portion 522 to establish the lower material portion 524 as a portioned instance of the compressible material.

As shown, the cutting assembly 230 extends transversely through transverse conduit 232 so that the edge portion 234 of the cutting assembly 230 cuts through the bulk instance 520 to separate the upper and lower material portions 522 and 524 of the bulk instances 520 into separate, respective and isolated instances of the compressible material. The upper surface 231 of the extended cutting assembly 230 further defines a bottom boundary of the upper channel 219 holding the upper material portion 522, and the lower surface 233 of the extended cutting assembly 230 further defines a top boundary of the lower channel 229 holding the lower material portion 524. A mechanism via which the cutting assembly (e.g., 230) may be enabled to extend transversely through a transverse conduit (e.g., 232), according to at least some example embodiments, is described further below with reference to at least FIGS. 7-14.

As shown in FIG. 5C, the supply of first gas 105 may be maintained (e.g., by control device 120) concurrently with S406. In some example embodiments, the supply of first gas 105 is at least partially inhibited, such that the pressure of gas above the upper material portion 522 is reduced, in response to the cutting assembly 230 being in an at least partially fully extended position.

Referring now to FIGS. 4 and 5D, at S408 the discharge assembly 240 is controlled (e.g., by control device 120) to supply second gas 107 into the top portion 239 of lower channel 229 to discharge the portioned instance (lower material portion 524) through the bottom opening 226 based on directing the second gas 107 through the conduit assembly 244 of the lower assembly 220 to impinge on a lower surface 233 of the cutting assembly 230 in the lower channel 229.

As shown in FIG. 5D, the conduit assembly 244 is configured to direct the second gas 107 to enter the lower channel 229 at a top portion 239 of the lower channel 229 such that the second gas 107 impinges on the lower surface 233 of the cutting assembly 230. The impinging second gas 107 may be reflected by the lower surface 233 to distribute over a top portion of the lower material portion 524 in the top portion 239 of the lower channel 229. As shown in at least FIG. 5D, the distributed second gas 107 may relatively uniformly exert a pressure over the top portion of the lower material portion 524 and thus may push the lower material portion 524 downwards and out of the channel assembly 200 via bottom opening 226. As shown, the sealing plate 250 may controlled (e.g., by control device 120) to be in an opened configuration concurrently with the operation at S408, such that the lower material portion is discharged out of the channel assembly 200 via bottom opening 226.

In some example embodiments, the channel assembly 200 may be configured to move (e.g., based on control of the channel assembly 200 by control device 120 of apparatus 100), and one or more of the gas source 104, the cutting assembly 230, and the discharge assembly 240 may be fixed in relation to the channel assembly 200 such that one or more of operations S402-S408 is controlled based on the channel assembly 200 moving in relation to one or more positions.

As referred to herein, a "position" may include a single point location or a range of locations (e.g., a "region") in space in relation to a fixed portion of apparatus 100 (e.g., power supply 108, control device 120, material supply source 102, some combination thereof, or the like).

In some example embodiments, the gas source 104 may be fixed in relation to the channel assembly 200, such that the gas source 104 is configured to supply the first gas through the top opening 214 of the channel assembly 200 based on the channel assembly 200 moving to a first position to be in fluid communication with the gas source 104. For example, as shown in FIG. 4, at S401 the channel assembly 200 may be moved (e.g., based on control of one or more elements of apparatus 100 by control device 120) to a first position such that the channel assembly 200 is in fluid communication with gas source 104. As a result of the channel assembly 200 being moved to the first position, first gas 105 may be supplied to compress the bulk instance 510 of compressible material at S404. In addition, in some example embodiments, including the example embodiments shown in FIG. 4, compressible material may be supplied into the channel assembly 202, at S402, based on the channel assembly 200 being at least in the first position. For example, at S402, based on the channel assembly 200 being moved to at least the first position, the first gas 105 may be supplied to push compressible material into the channel assembly 200.

In some example embodiments, the gas source 104 is configured to supply a continuous supply of the first gas 105, such that the supply of the first gas 105 through the top opening 214 of the channel assembly 200 is controlled based on the channel assembly 200 moving in relation to the first position. For example, in response to the channel assembly 200 being moved away from the first position, the supply of first gas 105 to the channel assembly 200 may be inhibited, even though the gas source 104 continues to supply the first gas 105, e.g., via an at least partially opened gas flow control valve. Where the apparatus 100 includes multiple channel assemblies 200, moving a first channel assembly 200 away from the first position to thus inhibit the supply of first gas 105 to the first channel assembly 200 may further include moving a second channel assembly 200 to the first position to thus initiate the supply of first gas 105 to the second channel assembly 200, based on maintaining a continuous supply of first gas 105 from gas source 104 to any channel assembly 200 that is at the first position. Such example embodiments are described further below with reference to additional drawings.

In some example embodiments, the channel assembly 200 may be configured to move and the cutting assembly 230 may be fixed in relation to the channel assembly 200, such that the cutting assembly 230 is configured to extend transversely through the continuous channel 290 (e.g., based on control of one or more elements of apparatus 100 by control device 120) based on the channel assembly 200 moving to a second position (e.g., based on control of one or more elements of apparatus 100 by control device 120). For example, as shown in FIG. 4, at S405 the channel assembly 200 may be moved (e.g., based on control of one or more elements of apparatus 100 by control device 120) to a second position such that the channel assembly 200 moves in relation to a fixed cutting assembly 230 to cause the cutting assembly 230 to extend transversely through the continuous channel 290, for example as shown in FIG. 5C.

In some example embodiments, the second position may be different from the first position and/or may at least partially overlap with the first position. For example, where the first position is a region that encompasses the second position, such that the second position is fully overlapped by the first position, the supply of first gas 105 may be maintained to a given channel assembly 200 at S405 and S406, concurrently with the channel assembly 200 being moved to the second position to cause extension of the cutting assembly 230 transversely through the continuous channel 290 of the channel assembly 200.

In some example embodiments, the channel assembly 200 may be configured to move (e.g., based on control of one or more elements of apparatus 100 by control device 120) and the discharge assembly 240 may be fixed in relation to the channel assembly 200, such that the discharge assembly 240 is configured (e.g., based on control of one or more elements of apparatus 100 by control device 120) to direct the second gas 107 into the lower channel 229 based on the channel assembly 200 moving to a third position to be in fluid communication with the discharge assembly 240. For example, as shown in FIG. 4, at S407 the channel assembly 200 may be moved (e.g., based on control of one or more elements of apparatus 100 by control device 120) to a third portion such that the channel assembly 200 moves in relation to a fixed discharge assembly 240 to cause the inlet 242 to move into fluid communication with an outlet of the discharge assembly 240 and to cause the discharge assembly 240 to direct the second gas 107 into the conduit assembly 244 of the channel assembly 200, for example as shown in FIG.

In some example embodiments, the third position may be different from the first position and/or the second position and/or may at least partially overlap with the first position and/or the second position.

In some example embodiments, the gas source 106 is configured to supply a continuous supply of the second gas 107, such that the supply of the second gas 107 through the conduit assembly 244 of the channel assembly 200 is controlled based on the channel assembly 200 moving in relation to the third position. For example, in response to the channel assembly 200 being moved away from the third position, the supply of second gas 107 to the conduit assembly 244 may be inhibited, even though the gas source 106 continues to supply the second gas 107, e.g., via an at least partially opened gas flow control valve. Where the apparatus 100 includes multiple channel assemblies 200, moving a first channel assembly 200 away from the third position to thus inhibit the supply of second gas 107 to the conduit assembly 244, may further include moving a second channel assembly 200 to the third position to thus initiate the supply of second gas 107 to the second channel assembly 200, based on maintaining a continuous supply of second gas 107 from gas source 106 to any channel assembly 200 that is at the third position. Such example embodiments are described further below with reference to additional drawings.

As described further below with reference to additional drawings, the apparatus 100 may include an assembly, for example a rotatable assembly, that is configured to move (e.g., based on control of one or more elements of apparatus 100 by control device 120) one or more channel assemblies 200 with reference to one or more of the first position, second positon, and third positon to control operation of one or more of the supply of first gas 105, the operation of the cutting assembly 230, and the supply of the second gas 107 with reference to the one or more channel assemblies 200.

In some example embodiments, including the example embodiments shown in FIGS. 2-3 and 5A-5D example, an apparatus 100 that includes a channel assembly 200 configured to utilize a gas (e.g., first gas 105 and/or second gas 107) to compress and portion a bulk instance 150 of material enables omission, from the apparatus 100, of a piston configured to compress the bulk instance of material within a given space, where the use of pistons may result in a relatively complex apparatus, as a piston may require a piston control system that may include a spring assembly, hydraulic assembly, cam assembly, some combination thereof, or the like in order to enable piston motion control, and thus may avoid frequent maintenance and upkeep that may be implemented to maintain in a piston control system in optimal working condition.

In addition, an apparatus 100 that includes a channel assembly 200 configured to utilize a gas (e.g., first gas 105 and/or second gas 107) to compress and portion a bulk instance 150 of material enables avoidance of frequent maintenance and upkeep that may be implemented to maintain in a piston control system that may result from the piston impacting a compressible material periodically in cycles, thereby inducing cyclic wear on the piston face.

In addition, an apparatus 100 that includes a channel assembly 200 configured to utilize a gas (e.g., first gas 105 and/or second gas 107) to compress and portion a bulk instance 150 of material enables avoidance of cyclic wear of the side edges of the piston of a piston control system that could result in constant maintenance and/or periodic replacement and thus avoids taking the apparatus offline, thereby avoiding at least temporarily halting portioned instance production.

Furthermore, an apparatus 100 that includes a channel assembly 200 configured to utilize a gas (e.g., first gas 105 and/or second gas 107) to compress and portion a bulk instance 150 of material enables improved ease of control and/or adjustment thereof in order to control the density of the bulk and portioned instances of a compressed material, at least in part by avoiding adjustment of the amount of compression applied by a piston of a piston control system to enable such density adjustment and further avoiding changes of piston compression over time due to wearing of apparatus elements and/or "drift" of apparatus element configurations. Thereby an apparatus 100 that includes a channel assembly 200 configured to utilize a gas (e.g., first gas 105 and/or second gas 107) to compress and portion a bulk instance 150 of material enables avoidance of complex and/or time-consuming maintenance that may require taking the apparatus out of operation for a period of time to perform such adjustment, thereby avoiding at least temporarily halting production of portioned instances of material.

In some example embodiments, the compressible material may have fluidic characteristics (e.g., may be "moist" and/or "wet"), such that the material may have a relatively high viscosity, and may be at least mildly adhesive to various surfaces (e.g., may be "sticky"). Such a material may at least partially adhere to portions of the apparatus 100, for example inner surfaces of a channel in which the material is compressed.

In some example embodiments, an apparatus 100 that includes a channel assembly according to some example embodiments, including the example embodiments shown in at least FIGS. 2-3 and 5A-5D (and further including the example embodiments shown in FIGS. 7-14 as described further below) is configured to enable compression and/or portioning of a bulk instance 150 of a compressible material, for example as shown in at least FIGS. 5A-5D, and thus provides an improved apparatus for portioning materials based on utilizing one or more supplies of gas to compress a bulk instance of material 150 and to discharge portioned instances of material. Such a use of gas may enable relatively simple and rapidly and easily adjustable control of material compression and discharge with reduced apparatus complexity, reduced maintenance requirements, and/or reduced risk of disrupting a target density and/or volume of the portioned instances of material during the discharge of said instances from the apparatus.

Figure 6A:
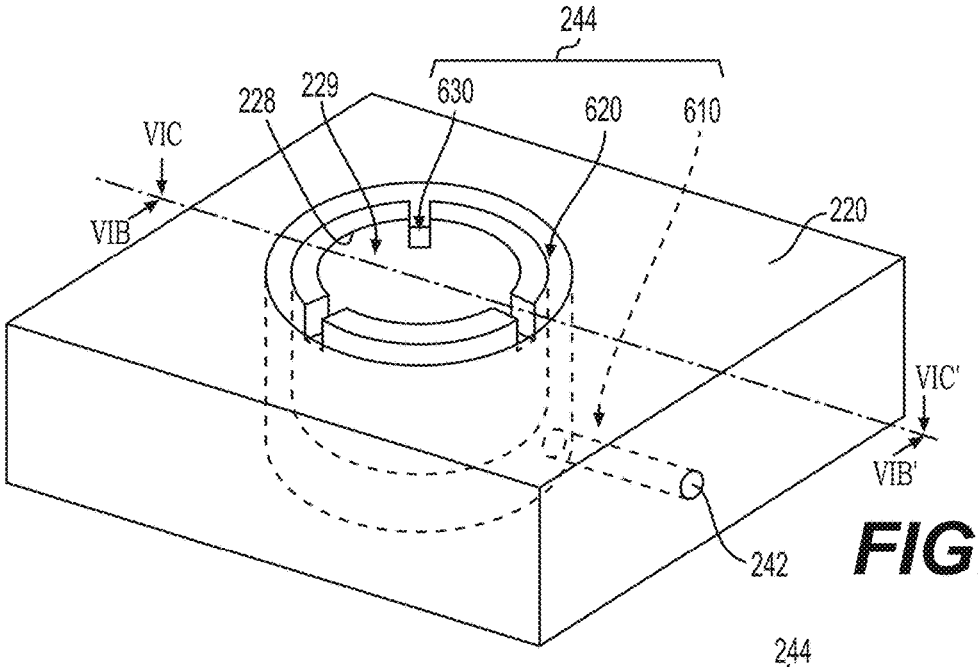
FIG. 6A is a perspective view of a lower assembly including an annular conduit assembly and bridging conduit assemblies, according to some example embodiments.
Figure 6B:
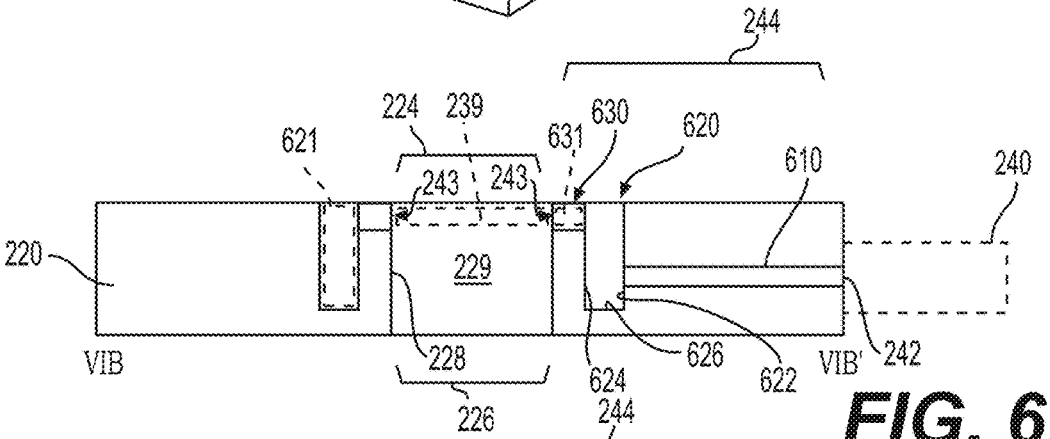
FIG. 6B is a cross-sectional view along view line VIB-VIB' of the lower assembly shown in FIG. 6A.
Figure 6C:
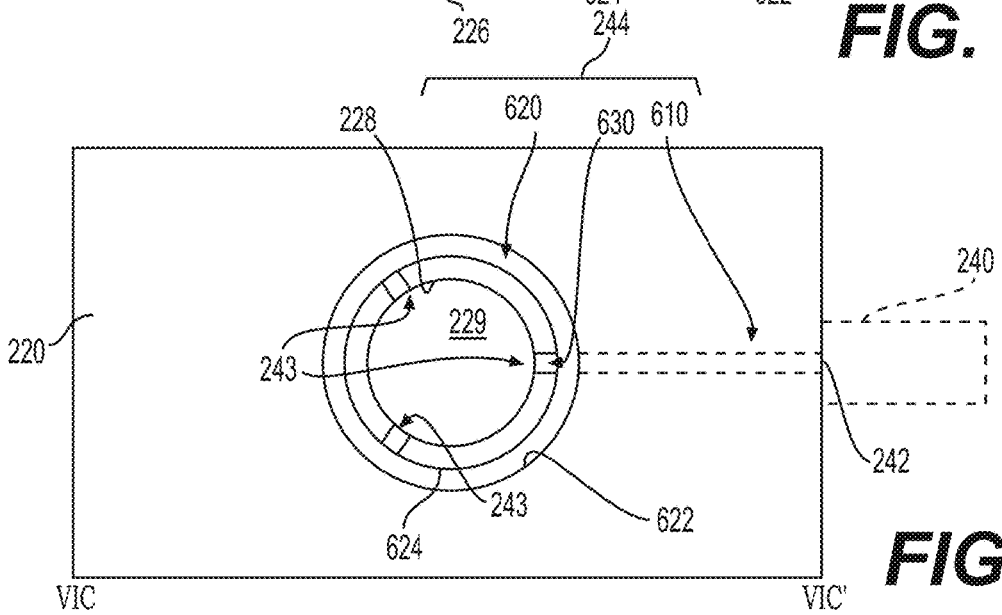
FIG. 6C is a plan view, along view line VIC-VIC', of the lower assembly shown in FIG. 6A.

FIG. 6A is a perspective view of a lower assembly including an annular conduit assembly and bridging conduit assemblies, according to some example embodiments. FIG. 6B is a cross-sectional view along view line VIB-VIB' of the lower assembly shown in FIG. 6A. FIG. 6C is a plan view, along view line VIC-VIC', of the lower assembly shown in FIG. 6A.

Referring to FIGS. 6A-6C, a lower assembly 220 may include a conduit assembly 244 that further includes an annular conduit assembly defining an annular conduit surrounding the lower channel, where the annular conduit assembly is configured to direct the second gas from the discharge assembly into the annular conduit.

For example, as shown in FIGS. 6A-6C, the lower assembly 220 may include a conduit assembly 244 that includes an annular conduit assembly 620 defining an annular conduit 621 surrounding the lower channel 229 and a conduit 610 extending from inlet 242 through an interior of the lower assembly 220 to the annular conduit assembly 620, such that the conduit 610 couples the annular conduit 621 to be in fluid communication with the inlet 242. A second gas 107 received at the inlet 242, as described above with reference to at least FIG. 3, may thus be directed into the annular conduit 621 via conduit 610.

As shown in FIGS. 6A-6C, the annular conduit assembly 620 may include an annular conduit 621 that is defined by outer sidewall 622, inner sidewall 624, and bottom surface 626. In the example embodiments shown in FIGS. 6A-6C, the annular conduit 621 of the annular conduit assembly 620 is open at a top end, but it will be understood that in some example embodiments the annular conduit assembly 620 may define an enclosed annular conduit 621 with a top surface.

As shown, the annular conduit assembly 620 may extend, at least partially within the interior of the lower assembly 220, at least partially around the lower channel 229. In FIGS. 6A-6C, for example, the annular conduit assembly 620 defines an annular conduit 621 that extends around an entirety of the lower channel 229, such that the annular conduit assembly 620 completely ("entirely") surrounds the lower channel 229.

In some example embodiments, the conduit assembly 244 further includes one or more bridging conduit assemblies that define one or more bridging conduits extending between the annular conduit assembly and a top end of the lower inner surface, where the one or more bridging conduit assemblies are configured to direct a second gas from the annular conduit to a top portion of the lower channel.

For example, as shown in FIGS. 6A-6C, the conduit assembly 244 may include bridging conduit assemblies 630 that extend from inner sidewall 624 to lower inner surface 228 and thus define respective bridging conduits 631 that extend between the annular conduit assembly 620 and respective outlets 243 in a top end of the lower inner surface 228. In the example embodiments shown in FIGS. 6A-6C, a bridging conduit 631 of a bridging conduit assembly 630 is open at a top end, but it will be understood that in some example embodiments the bridging conduit assembly 630 may enclose the bridging conduit 631 thereof with a top surface.

As shown in FIGS. 6A-6C, each bridging conduit 631 may couple the annular conduit 621 of the annular conduit assembly 620 and the lower channel 229 in fluid communication. As a result, in response to a second gas 107 being directed via conduit 610 into the annular conduit 621 of the annular conduit assembly 620, the bridging conduits 631 of the bridging conduit assemblies 630 may direct the second gas from the annular conduit 621 into the lower channel 229 at a top portion 239 thereof, such that the second gas 107 is directed to impinge on a lower surface 233 of a cutting assembly 230 that, in the extended configuration, defines a top end ("top boundary") of the lower channel 229 as shown in at least FIG. 5D (described above).

As shown in FIGS. 6A-6C, the conduit assembly 244 may include multiple bridging conduit assemblies 630, but it will be understood that in some example embodiments the conduit assembly 244 may include a single bridging conduit assembly 630 defining a single bridging conduit 631 in the lower assembly 220. In some example embodiments, where the conduit assembly 244 includes multiple bridging conduit assemblies 630, the bridging conduit assemblies 630 may be spaced apart equidistantly around a circumference of the lower inner surface 228. For example, as shown in FIGS. 6A-6C, where conduit assembly 244 includes three bridging conduit assemblies 630, the three bridging conduit assembly 630 are spaced apart equidistantly around the circumference of the lower inner surface 228. As a result, because the annular conduit assembly 620 extends at least partially around the lower channel 229, based on the second gas 107 being directed via conduit 610 into the annular conduit 621 of the annular conduit assembly 620, the second gas 107 may distribute relatively uniformly throughout the annular conduit before passing through the bridging conduits 631 into the top portion 239 of the lower channel 229. As a result, the bridging conduits 631 may direct the second gas 107 into the lower channel 229 relatively uniformly around a circumference of the top end of the lower inner surface 228, such that a downwards force applied on the lower material portion 524 held in the lower channel 229 by the second gas 107, directed by the multiple bridging conduits 631 to impinge on the lower surface 233 of the cutting assembly 230 to be redirected to apply force to the top surface of the lower material portion 524, may be pushed with a force that is relatively uniform across the top surface of the lower material portion 524. As a result, the bridging conduits 631 may enable the lower material portion 524 be pushed through the bottom opening 226 via application of a relatively uniform downwards force imparted by reflected second gas 107, thereby reducing the risk of breakup of the structure of the lower material portion 524 by the force applied via the second gas 107 and further reducing the risk of disrupting the structural integrity of the lower material portion (e.g., breaking apart due to uneven force applied to discharge the lower material portion 524) and thus ensuring that portioned instances produced via discharge of lower material portions 524 have relatively consistent shape and structure.

Figure 7:
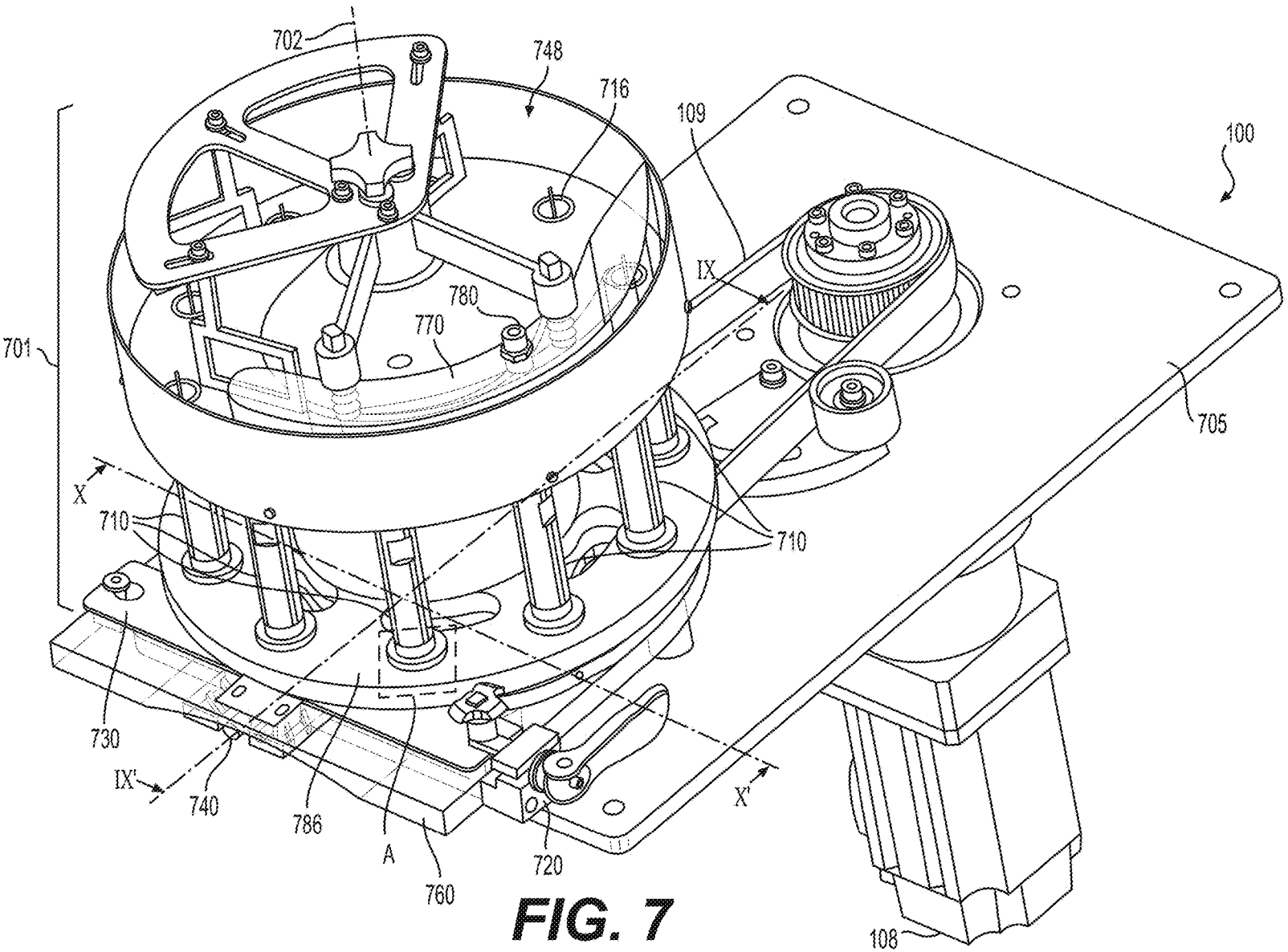
FIG. 7 is a perspective view of an apparatus including a rotating assembly with a plurality of channel assemblies, according to some example embodiments.
Figure 8:
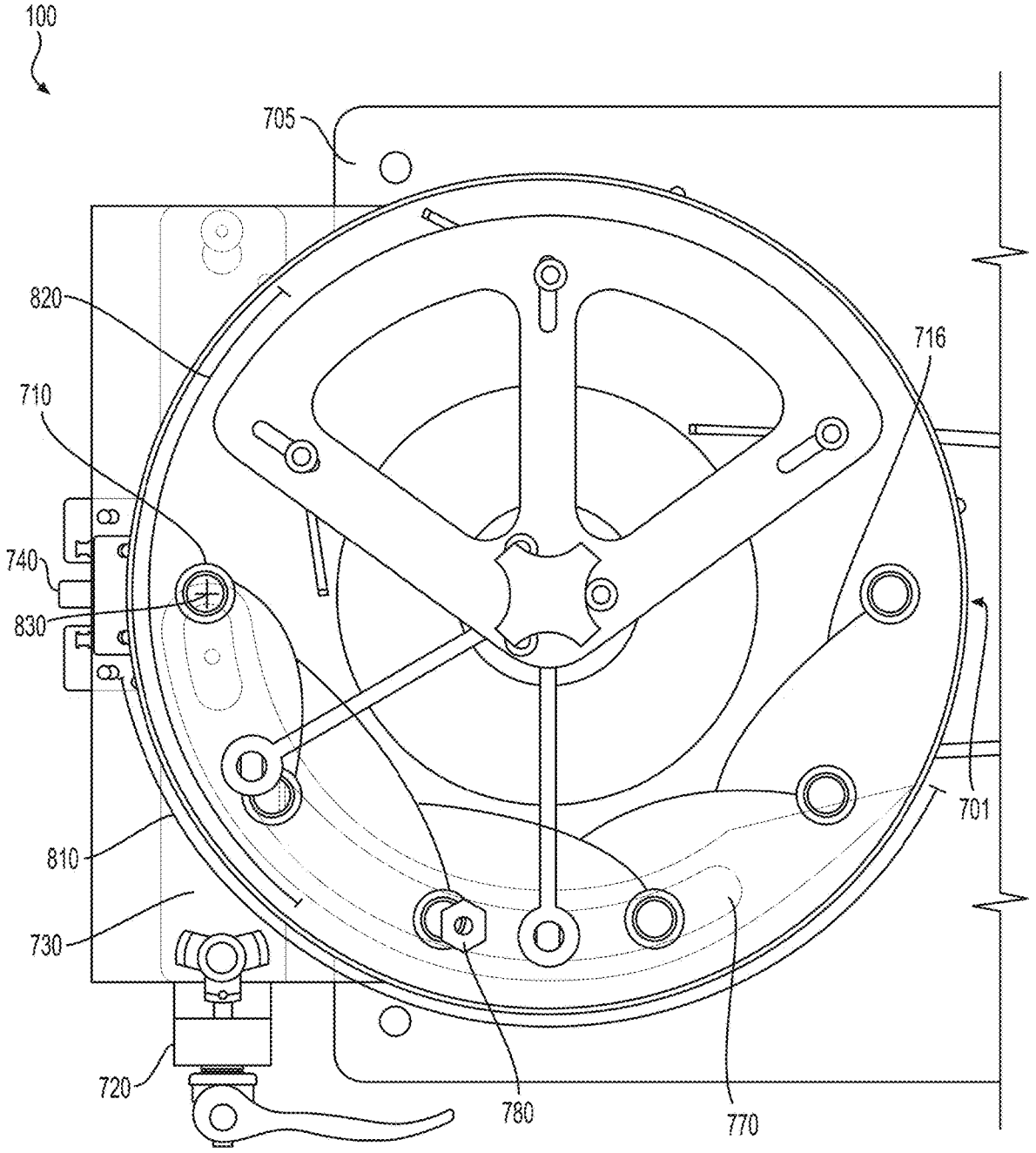
FIG. 8 is a plan view of the apparatus shown in FIG. 7.
Figure 9:
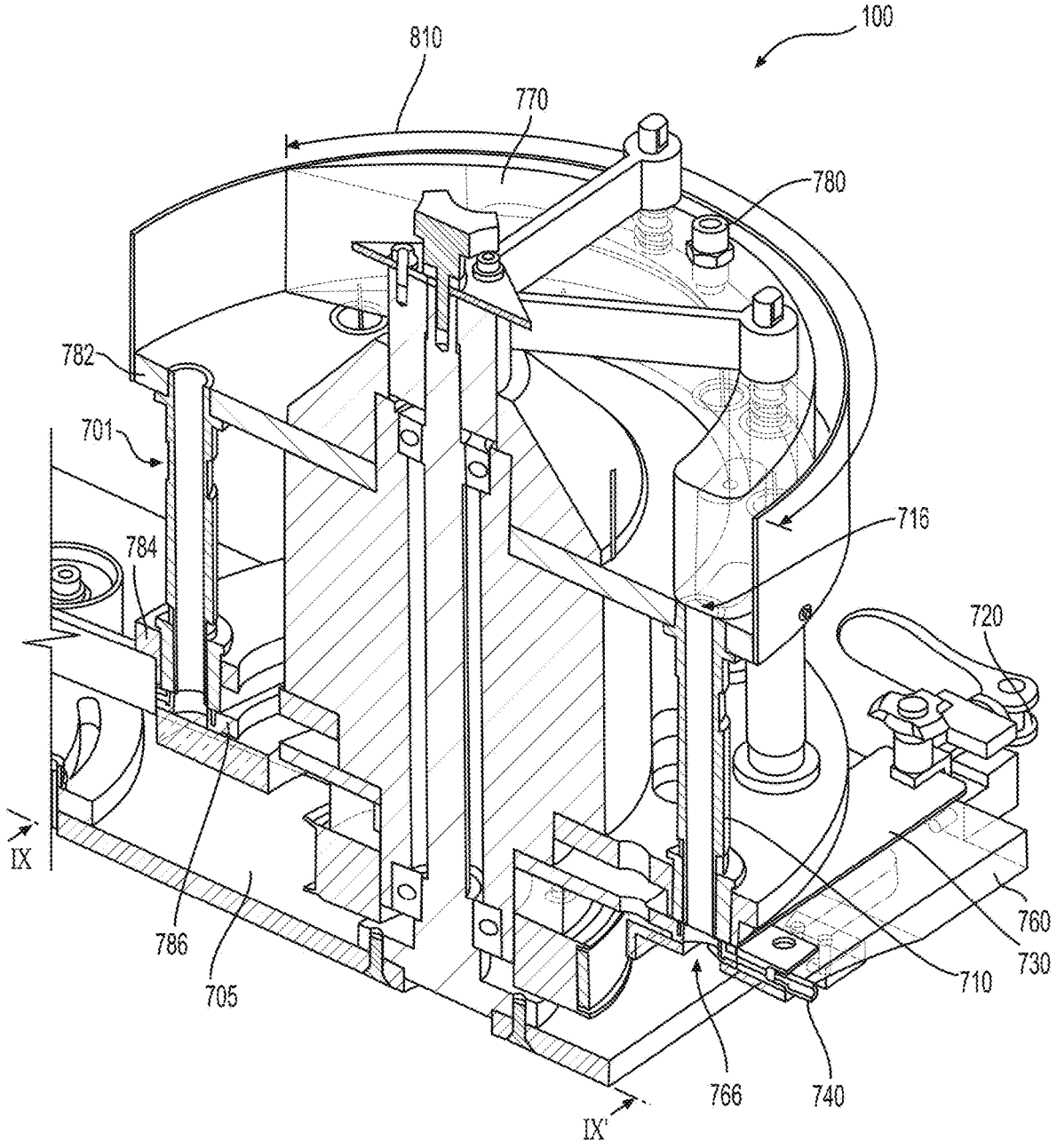
FIG. 9 is a three-dimensional cross-sectional view, along view line IX-IX', of the apparatus shown in FIG. 7.
Figure 10:
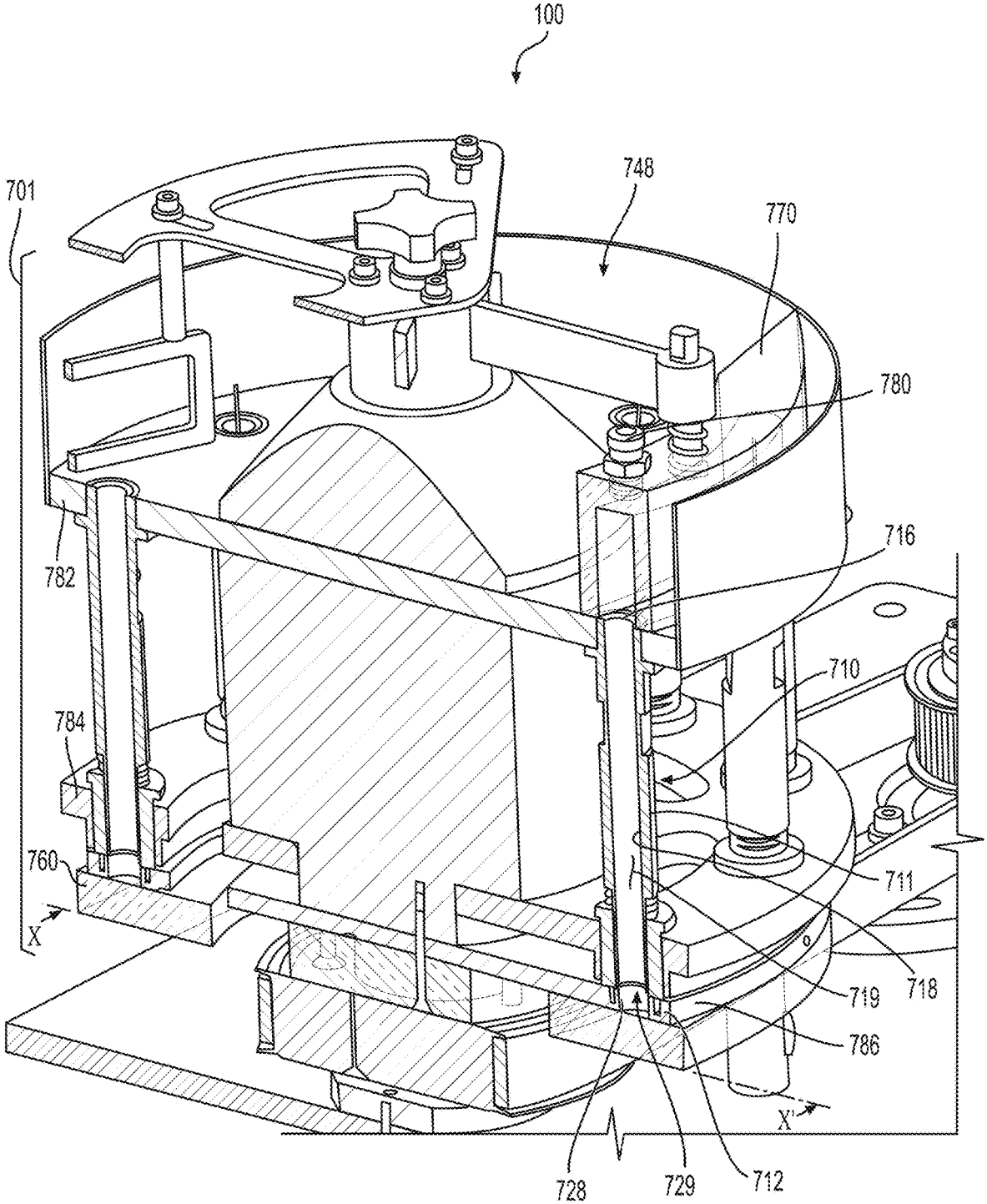
FIG. 10 is a three-dimensional cross-sectional view, along view line X-X', of the apparatus shown in FIG. 7.
Figure 11:
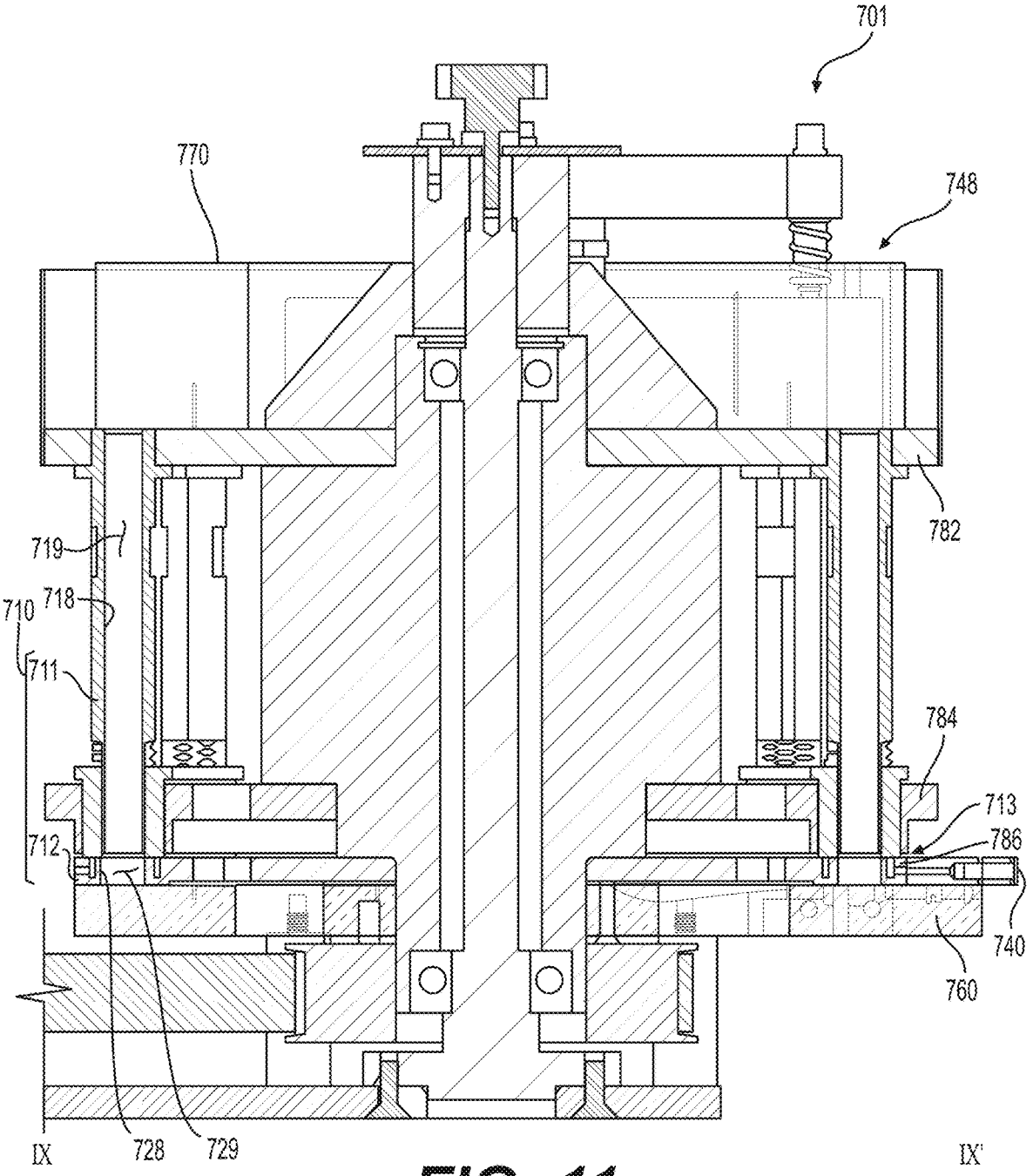
FIG. 11 is a two-dimensional cross-sectional view, along line IX-IX', of the apparatus shown in FIG. 7.
Figure 12:
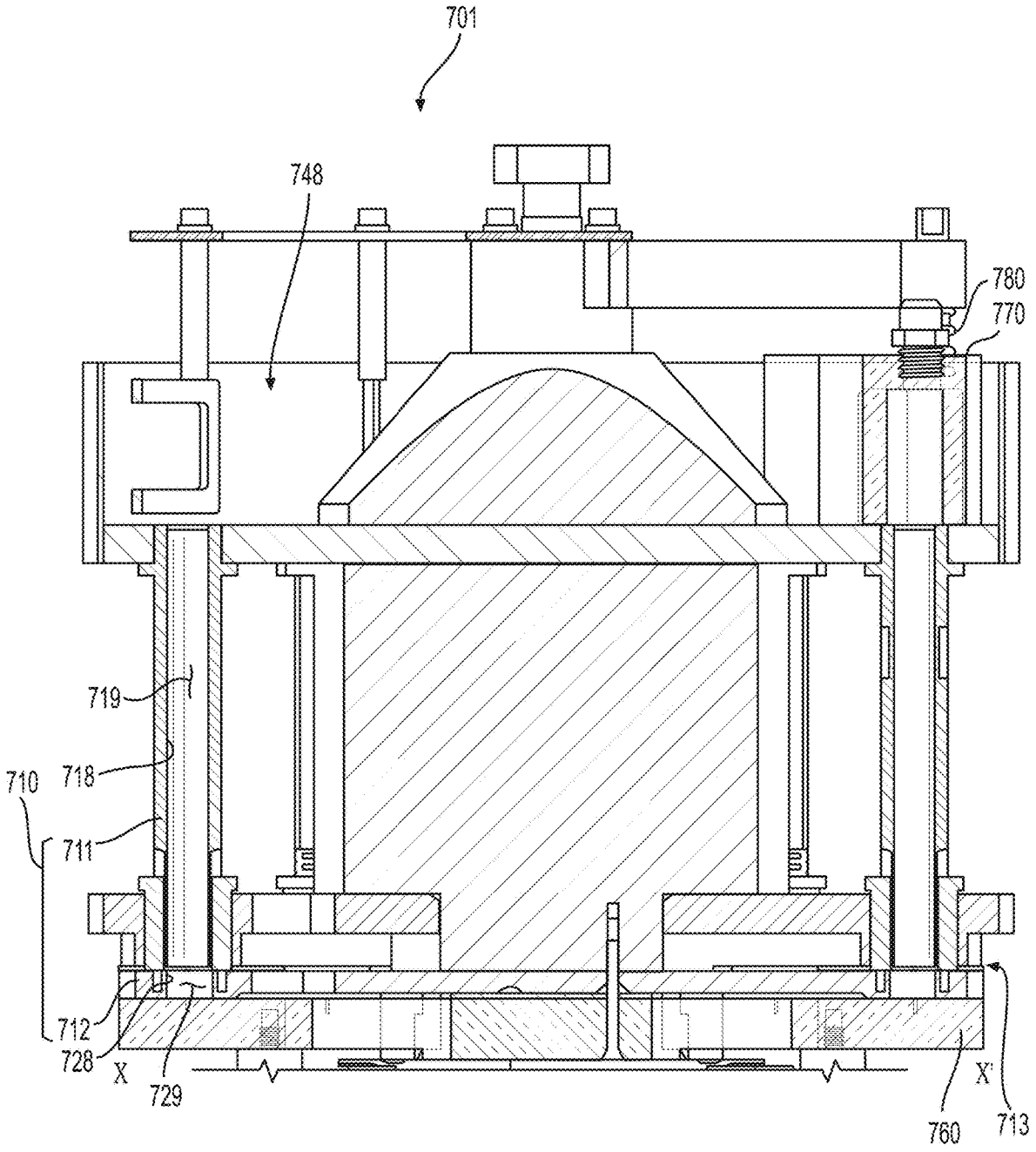
FIG. 12 is a two-dimensional cross-sectional view, along line X-X', of the apparatus shown in FIG. 7.
Figure 13:
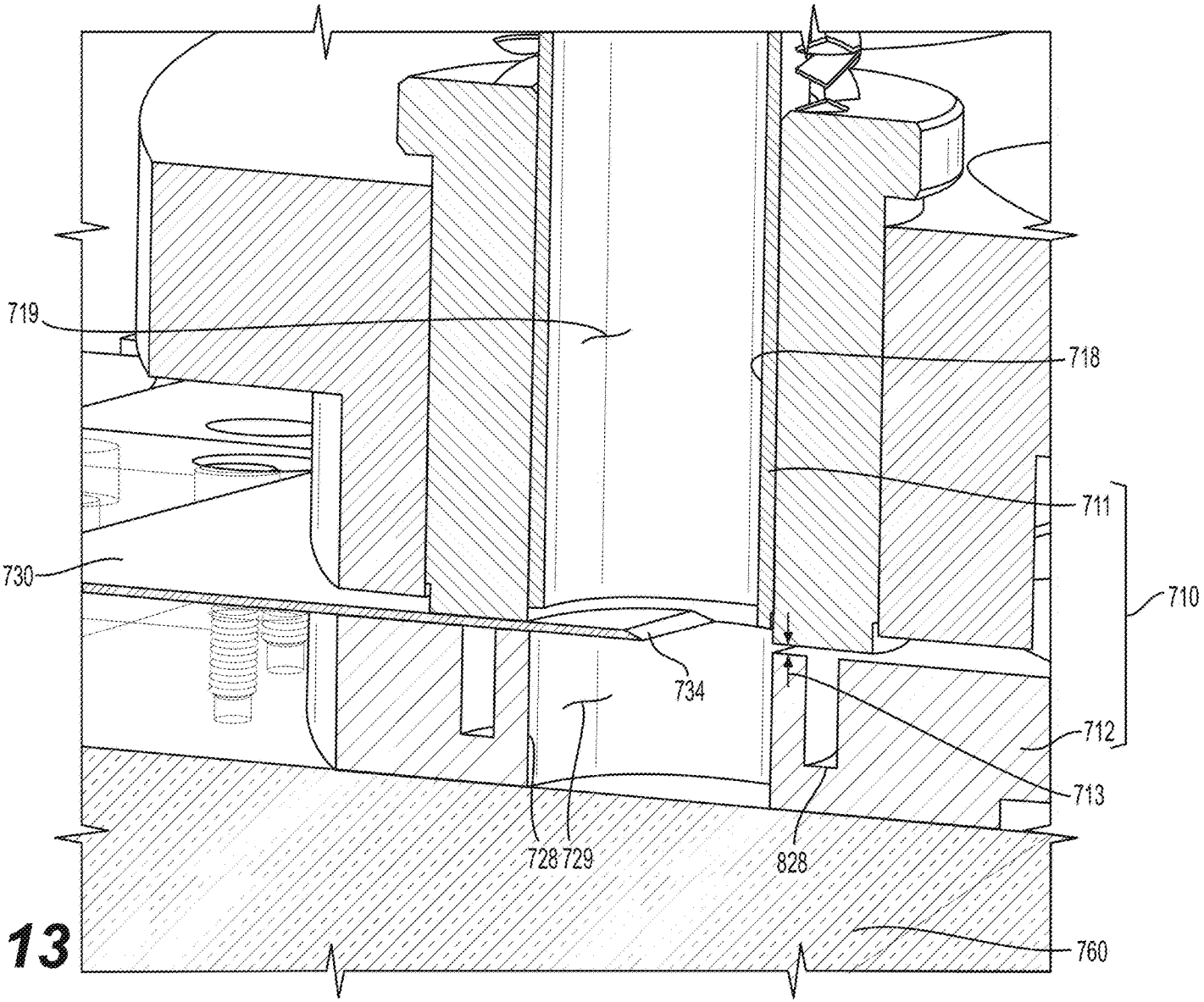
FIG. 13 is a three-dimensional cross-sectional view of the region 'A' of the apparatus shown in FIG. 7.
Figure 14:
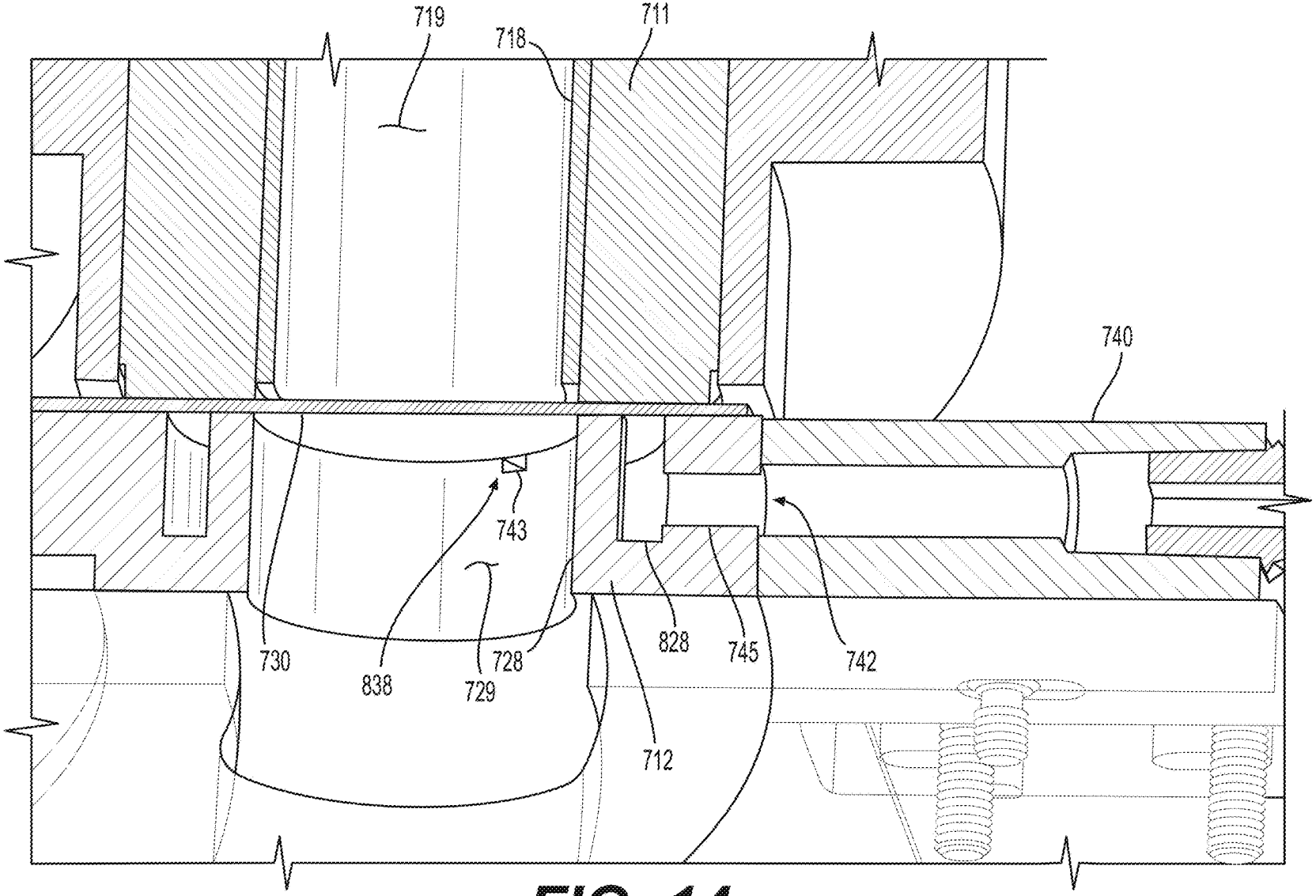
FIG. 14 is a three-dimensional cross-sectional view, along view line IX-IX', of the apparatus shown in FIG. 7.

FIGS. 7-14 are views of an apparatus including a rotating assembly with a plurality of channel assemblies, according to some example embodiments. FIG. 7 is a perspective view of the apparatus, according to some example embodiments. FIG. 8 is a plan view of the apparatus shown in FIG. 7. FIG. 9 is a three-dimensional cross-sectional view, along view line IX-IX', of the apparatus shown in FIG. 7. FIG. 10 is a three-dimensional cross-sectional view, along view line X-X', of the apparatus shown in FIG. 7. FIG. 11 is a two-dimensional cross-sectional view, along line IX-IX', of the apparatus shown in FIG. 7. FIG. 12 is a two-dimensional cross-sectional view, along line X-X', of the apparatus shown in FIG. 7. FIG. 13 is a three-dimensional cross-sectional view of the region 'A' of the apparatus shown in FIG. 7. FIG. 14 is a three-dimensional cross-sectional view, along view line IX-IX', of the apparatus shown in FIG. 7. The apparatus shown in FIGS. 7-14 may be included in and/or may be the apparatus 100 shown in FIG. 1A. In FIGS. 7-14, dashed-lines indicate elements that are hidden from direct view.

The example embodiments of the apparatus shown in FIGS. 7-14 may be different from the example embodiments of the apparatus shown in at least FIGS. 2-3 and FIGS. 5A-5D. For example, as described further herein, instead of including a sealing plate 250 that is configured to move to expose or seal the bottom opening 226 as shown in FIGS. 2-3 and FIG. 5A-5D, the apparatus according to some example embodiments as shown in FIGS. 7-14 may include a fixed element (760) that includes a fixed opening (766), where the apparatus is configured to move a channel assembly to selectively align with the opening (766) to selectively expose or seal a bottom opening of the channel assembly, instead of moving a sealing plate to selectively expose or seal a bottom opening of the channel assembly.

In some example embodiments, an apparatus may include a rotatable assembly that is configured to rotate around a central longitudinal axis and includes a plurality of channel assemblies. The plurality of channel assemblies, each of which may be similar to the channel assembly 110 as described herein, may be spaced apart around a circumference of the rotatable assembly.

For example, as shown in FIGS. 7-14, the apparatus 100 may include a rotatable assembly 701 that is configured to rotate around a central longitudinal axis 702. The rotatable assembly 701 is shown in FIGS. 7-14 to include ten (10) channel assemblies 710 spaced apart around a circumference of the rotatable assembly 701, but it will be understood that the rotatable assembly 701 may include any quantity of channel assemblies 710. Each channel assembly 710 as described herein may be any of the channel assemblies described herein, including any of the channel assembly 110 shown in FIG. 1A and the channel assembly 200.

While the rotatable assembly 701 shown in FIGS. 7-14 includes a single ring pattern of channel assemblies 710 spaced apart around a circumference of the rotatable assembly 701, it will be understood that in some example embodiments the rotatable assembly 701 may include multiple (e.g., concentric) ring patterns of channel assemblies spaced apart around the rotatable assembly 701. For example, rotatable assembly 701 could include at least two concentric arrangements ("patterns," "configurations," etc.) of channel assemblies 710 spaced apart at equal angular distances (e.g., 9 degrees, 10 degrees, 18 degrees, 20 degrees, 36 degrees, or the like) around the rotatable assembly 701 (e.g., around longitudinal axis 702), such that a given cylindrical sector, of any given central angle around longitudinal axis 702 of the rotatable assembly 701 includes an equal quantity of both channel assemblies 710 of an outer pattern of channel assemblies extending around the longitudinal axis 702 (e.g., a pattern that is distal to longitudinal axis 702) and channel assemblies 710 of an inner pattern of channel assemblies extending around the longitudinal axis 702 (e.g., a pattern that is proximate to longitudinal axis 702).

In some example embodiments, including the example embodiments shown in at least FIGS. 7-14, the rotatable assembly 701 is configured to rotate (e.g., based on control by power supply 108) at a rate of about 10 revolutions per minute ("rpm") to about 40 rpm. In some example embodiments, including the example embodiments shown in at least FIGS. 7-14, an apparatus 100 that includes the rotatable assembly 701 is configured to portion and discharge instances of compressible material ("produce portioned instances of compressible material") at a rate of about 100 portioned instances/minute to about 400 portioned instances/minute, for example based on rotatable assembly 701 rotating at a rate of about 10 rpm to about 40 rpm.

In some example embodiments, including the example embodiments shown in at least FIGS. 7-14, the rotatable assembly 701 is configured to rotate (e.g., based on control by power supply 108) to rotate at a rate of about 10 rpm to about 20 rpm. In some example embodiments, including the example embodiments shown in at least FIGS. 7-14, an apparatus 100 that includes the rotatable assembly 701 is configured to portion and discharge instances of compressible material ("produce portioned instances of compressible material") at a rate of about 100 portioned instances/minute to about 200 portioned instances/minute, for example based on rotatable assembly 701 rotating at a rate of about 10 rpm to about 20 rpm.

As shown in at least FIG. 7, the apparatus 100 includes a power supply 108 that is a motor configured to cause rotatable assembly 701 to rotate via drive belt 109, but it will be understood that the power supply may be any power supply that may impart rotational motion to the rotatable assembly 701. For example, the power supply 108 may be a motor (e.g., an electric motor) that is directly coupled to the rotational assembly 701 so that rotation of a driveshaft of the motor is converted directly into rotation of the rotatable assembly 701.

In some example embodiments, where an apparatus 100 includes a rotatable assembly, the gas source 104 of the apparatus may be fixed in relation to the rotatable assembly. As a result, the gas source 104 may be configured to supply the first gas 105 through a top opening 716 of a given channel assembly 710 of the plurality of channel assemblies 710 based on the rotatable assembly rotating to move the given channel assembly 710 to a first position to be in fluid communication with the gas source 104.

For example, as shown in FIGS. 7-14, apparatus 100 includes discs 782 and 784 through which the channel assemblies 710 extend, and a hopper 748 and a hopper enclosure 770 are above the upper disc, where the hopper enclosure 770 is fixed in relation to the rotatable assembly 701 and where a first gas port 780 is fixed to the hopper enclosure 770 such that the first gas port 780 is fixed in relation to the rotatable assembly 701. As the rotatable assembly 701 rotates, and thus rotates the channel assemblies 710 around the longitudinal axis 702, the hopper enclosure 770 and first gas port 780 remain fixed in place. As a result, as a given channel assembly 710 moves around the longitudinal axis 702, the channel assembly 710 periodically passes underneath (e.g., in fluid communication with) the hopper enclosure 770 and first gas port 780. In some example embodiments, including the example embodiments shown in FIGS. 7-14, the hopper enclosure 770 is a structure having sidewall elements and a top surface element that are coupled together and/or may be integral (e.g., may be one continuous instance of material) to establish an internal space ("enclosure") that is bounded on top and side ends by the structure of the hopper enclosure 770 and is bound on a bottom end by upper disc 782 that includes openings 716. As shown in FIGS. 7-14, at least one sidewall portion of the hopper enclosure 770 structure includes an opening that is open to hopper 748, such that material supplied into the hopper 748 may enter the internal space ("enclosure") of the hopper enclosure 770. As further shown in FIGS. 7-14, the first gas port 780 may extend through the top surface element of the hopper enclosure 770 to be in fluid communication with the internal space ("enclosure") of the hopper enclosure 770, such that the first gas port 780 enables a gas to be supplied into the interior space ("enclosure") of ("at least partially defined by") the hopper enclosure 770.

The hopper 748 is configured to be loaded with compressible material from a material supply source 102 (not shown in FIGS. 7-14), such that the compressible material may enter the channel assemblies 710 via the top openings 716 that are in the bottom of the hopper 748. Each top opening 716 as described herein may be any of the top openings described herein, including the top opening 214.

Additionally, the hopper enclosure 770 is configured to establish an enclosure, such as the enclosure 260 described above with reference to at least FIG. 3, wherein the first gas 105 may be supplied via the first gas port 780 to both assist in inserting the compressible material into a channel assembly 710 under the hopper enclosure 770 and to compress the bulk instance of compressible material held within a channel assembly 710 that is underneath the hopper enclosure 770. For example, as described above, the hopper enclosure 770 may include sidewall elements and a top surface element that collectively define an internal space ("enclosure") that has at least one opening in fluid communication with the space of the hopper 748, and the hopper enclosure 770 may be fixed in position in relation to the remainder of the rotatable assembly 701 (e.g., the upper disc 782 with openings 716 which may rotate beneath the hopper enclosure 770), and the compressible material may be supplied from hopper 748 into the internal space ("enclosure") of the hopper enclosure 770 via the at least one opening based on the rotatable assembly 701 rotating to cause compressible material to be directed into the hopper enclosure 770 via the at least one opening as the rotatable assembly 701 rotates.

Because the hopper enclosure 770 and first gas port 780 are fixed in position in relation to the rotatable assembly 701, the gas source 104 may supply a continuous supply of the first gas 105 to the hopper enclosure 770 via the first gas port 780. As a result, the supply of the first gas 105 to a given channel assembly 710 may be controlled by the apparatus 100 based on rotation of the rotatable assembly 701 to move the given channel assembly 710 to a position under the hopper enclosure 770.

Restated, the range ("region") of locations of a given channel assembly 710 of the plurality of channel assemblies 710 may have and remain in fluid communication with (e.g., "underneath") the hopper enclosure 770 may be referred to herein as a "first position 810" based on the channel assemblies 710 under the hopper enclosure 770 being in fluid communication with the gas source 104 via the first gas port 780. Thus, in order to cause at least the gas source 104 to supply first gas 105 through the top opening 716 of a channel assembly 710 to compress the bulk instance of compressible material held in the continuous channel 290 of the channel assembly 710, the apparatus may rotate the rotatable assembly 701 to move the channel assembly 710 to the first position 810.

In some example embodiments, where an apparatus 100 includes a rotatable assembly, the cutting assembly 730 of the apparatus 100 may be fixed in relation to the rotatable assembly 701. As a result, the cutting assembly 730 may be configured to extend transversely through the continuous channel 290 of the given channel assembly 710 based on the rotatable assembly rotating to move the given channel assembly 710 to a second position. The cutting assembly 730 as described herein may be any of the cutting assemblies as described herein, including any of the cutting assembly 130 shown in FIG. 1A and the cutting assembly 230 shown in FIGS. 2-3 and FIGS. 5A-5D.

For example, as shown in FIGS. 7-14 and as further described with reference to FIGS. below, apparatus 100 includes, in addition to discs 782 and 784 through which the channel assemblies 710 extend, a lower disc 786 that includes portions that each define a separate lower assembly 712 of a separate channel assembly 710 of the plurality of channel assemblies 710 of the apparatus. The upper assembly 711 and lower assembly 712 as described herein and as shown in FIGS. 7-14 may be any of the upper assemblies and lower assemblies as described herein, including the upper assembly 210 and the lower assembly 220 shown in at least FIGS. 2-3 and FIGS. 5A-5D, respectively. The apparatus 100 includes a gap space between the upper disc 782 and lower disc 786, and the gap space may define a transverse conduit 713 through which a cutting assembly 730 may extend. The transverse conduit 713 as described herein may be any of the transverse conduits described herein, including the transverse conduit 232.

As further shown in FIGS. 7-14, the apparatus 100 includes a cutting assembly 730 that is fixed in place in relation to rotatable assembly 701 via at least fixing assembly 720. The cutting assembly extends through a portion of the gap space between discs 784 and 786. The region of space vertically overlapping the fixed cutting assembly 730 is referred to herein as a "second position 820." As shown in at least FIG. 13, based on the rotatable assembly 701 rotating to move a given channel assembly 710 into the second position 820, the upper and lower assemblies 711 and 712 of the channel assembly 710 may move in relation to the cutting assembly 730 such that the cutting assembly 730 "extends" (via relative motion of the fixed cutting assembly 730 in relation to the moving upper and lower assemblies 711 and 712) transversely through the continuous channel 790 of the channel assembly 710 (e.g., continuous channel 290) so as to isolate the upper and lower channels 719 and 729 of the channel assembly 710 from each other. Furthermore, as noted above with reference to FIG. 5C, based on the cutting assembly 730 "extending" through the continuous channel 790 of the channel assembly 710 in response to the channel assembly 710 moving to the second position 820, the edge portion 734 of the cutting assembly 730 may sever a lower material portion 524 in the lower channel 729 from an upper material portion 522 in the upper channel 719, thereby producing a portioned instance of compressible material. Each continuous channel 790, upper channel 719, and lower channel 729 as described herein may be any of the continuous channels, upper channels, and lower channels described herein, respectively, including any of the continuous channel 290, upper channel 219, and lower channel 229, respectively.

As shown in FIGS. 7-14, the first position 810 and the second positions 820 are regions of space that at least partially overlap in a horizontal direction. Thus, for example, a given channel assembly 710 may be simultaneously in the first position 810 and the second position 820 as the rotatable assembly 701 rotates to move the channel assembly 710 around the longitudinal axis 702. As a result, first gas 105 may be supplied into the channel assembly 710 to compress at least a portion of the bulk instance 520 simultaneously with the cutting assembly 730 extending through the continuous channel 790 of the channel assembly 710 to isolate the upper and lower channels 719 and 729 of the channel assembly 710.

In some example embodiments, where an apparatus 100 includes a rotatable assembly 701, the discharge assembly 740 (which may be any of the discharge assemblies described herein, including discharge assembly 240) of the apparatus 100 may be fixed in relation to the rotatable assembly 701. As a result, the discharge assembly 740 may be configured to direct the second gas 107 into the lower channel 729 of a given channel assembly 710 based on the rotatable assembly 701 rotating to move the given channel assembly 710 to a third position so that an inlet 742 of a conduit assembly 744 of the lower assembly 712 of the given channel assembly 710 to be in fluid communication with the discharge assembly 740. Each discharge assembly 740, inlet 742, and conduit assembly 744 as described herein may be any of the discharge assemblies, inlets, and conduit assemblies described herein, respectively, including any of the discharge assembly 240, inlet 242, and conduit assembly 244, respectively.

For example, as shown in FIGS. 7-14, the discharge assembly 740 is fixed in place in relation to the rotatable assembly 701. As further shown in FIGS. 7-14, and as further described with reference to FIGS. 15-16C below, apparatus 100 includes a lower disc 786 that includes portions that each define a separate lower assembly 712 of a separate channel assembly 710 of the plurality of channel assemblies 710 of the apparatus. Each portion of the disc 786 includes a separate lower inner surface 728, a separate inlet 742, and a separate conduit assembly 744 configured to direct second gas 107 from inlet 742 to an outlet 743 at a top end of the respective lower inner surface 718. Each lower inner surface 728, inlet 742, conduit assembly 744, and outlet 743 as described herein may be any of the lower inner surfaces, inlets, conduit assemblies, and outlets described herein, respectively, including any of the lower inner surface 228, inlet 242, conduit assembly 244, and outlet 243, respectively.

As shown in FIGS. 7-14, the fixed discharge assembly 740 may supply second gas 107 into a given conduit assembly 744 of a given channel assembly 710 based on the rotatable assembly 701 rotating to move the channel assembly 710 such that a given portion of disc 286 that comprises the lower assembly 712 of the given channel assembly 710 aligns with the discharge assembly 740 to position inlet 742 of the given lower assembly 712 in fluid communication with the discharge assembly 740. Then, discharge assembly 740 may supply the second gas 107 into the aligned conduit assembly 744 of the given lower assembly 712 to be directed into the top portion of the lower channel 729 of the given aligned channel assembly 710.

As shown, second gas 107 may be supplied only to the lower assembly 712, of the plurality of lower assemblies 712 in disc 786, that is aligned with the discharge assembly 740, for example as shown in FIG. 14. Other lower assemblies 712 that are not aligned with the fixed discharge assembly 740 may not receive the second gas 107.

Thus, as described herein, a position associated with alignment of a channel assembly 710 (e.g., the inlet 742 of the lower assembly 712 thereof) with discharge assembly 740 may be referred to herein as a "third position 830," such that a channel assembly 710 that is moved to the third position 830 may align the inlet 742 thereof with the fixed discharge assembly and the second gas 107 enters the conduit assembly 744 of the given channel assembly 710.

As shown in FIG. 7, the third position 830 is encompassed within at least the second position 820, such that the third position 830 overlaps with at least the second position 820 in a horizontal direction. It will be understood that, in some example embodiments, the first position 810, the second position 820, and the third position 830 may be the same as or different from each other.

As shown in FIGS. 7-14, apparatus 100 may include a sealing plate 760 that is fixed in relation to rotatable assembly 701 and is located under disc 786. Sealing plate 760 includes a conduit 766 that is aligned with the third position 830. The sealing plate 760 is configured to perform the functionality described above with reference to the sealing plate 250 shown in FIGS. 2-3 and FIGS. 5A-5D, so that moving a channel assembly 710 to the third position 830, in addition to aligning the conduit assembly 744 of the channel assembly 710 to be in fluid communication with the discharge assembly 740, aligns a bottom opening (e.g., bottom opening 216 as shown in FIGS. 2-3 and 5A-5D) of the channel assembly 710 with the conduit 766 to enable a portioned instance of compressible material to be discharged from a lower channel 729 of the given channel assembly 710 via the bottom opening and aligned conduit 766. When a given channel assembly 710 is not aligned with the third position 830, the channel assembly 710 may not be aligned with conduit 766 and thus the solid upper surface of the sealing plate 760 may inhibit compressible material held in the continuous channel 290 of the channel assembly 710 from exiting the given channel assembly 710 via the bottom opening of the given channel assembly 710.

As shown in at least FIG. 7, the hopper enclosure 770 and first gas port 780, cutting assembly 730, and discharge assembly 740 are each fixed in relation to the rotatable assembly 701. For example, in FIG. 7 each of the hopper enclosure 770 and first gas port 780, cutting assembly 730, and discharge assembly 740 are each fixed to plate 705. However, it will be understood that, in some example embodiments, one or more of the hopper enclosure 770 and first gas port 780 (and thus the gas source 104), cutting assembly 730, and discharge assembly 740 are not fixed in relation to the rotatable assembly 701 and thus may move in relation to plate 705. Cutting assembly 730 may be configured to move in relation to plate 705 to extend transversely through a continuous channel 290 of one or more channel assemblies 710 included in the rotatable assembly 701.

Figure 15:
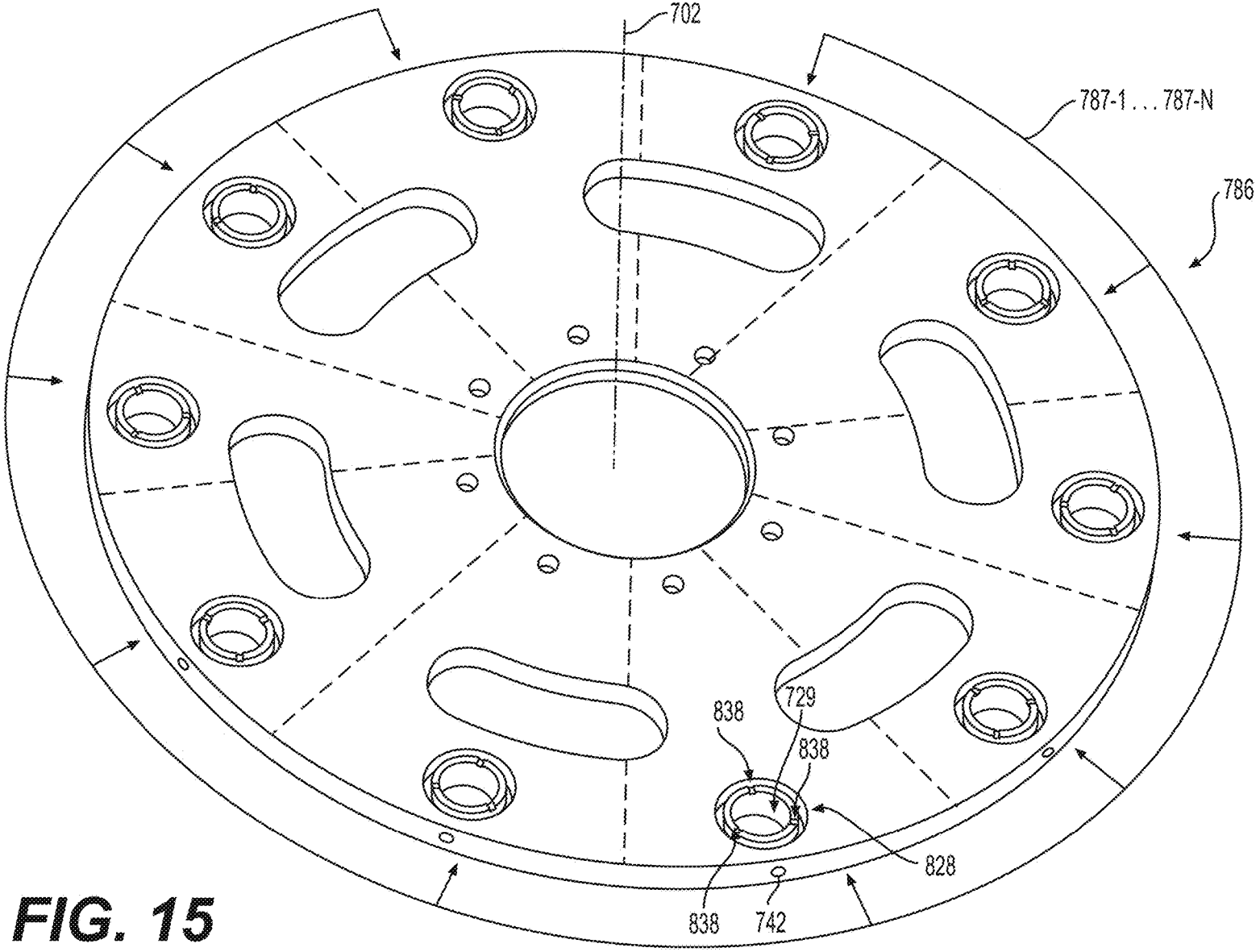
FIG. 15 is a perspective view of a disc assembly including a plurality of lower assemblies of a plurality of channel assemblies of the apparatus shown in FIG. 7.
Figure 16A:
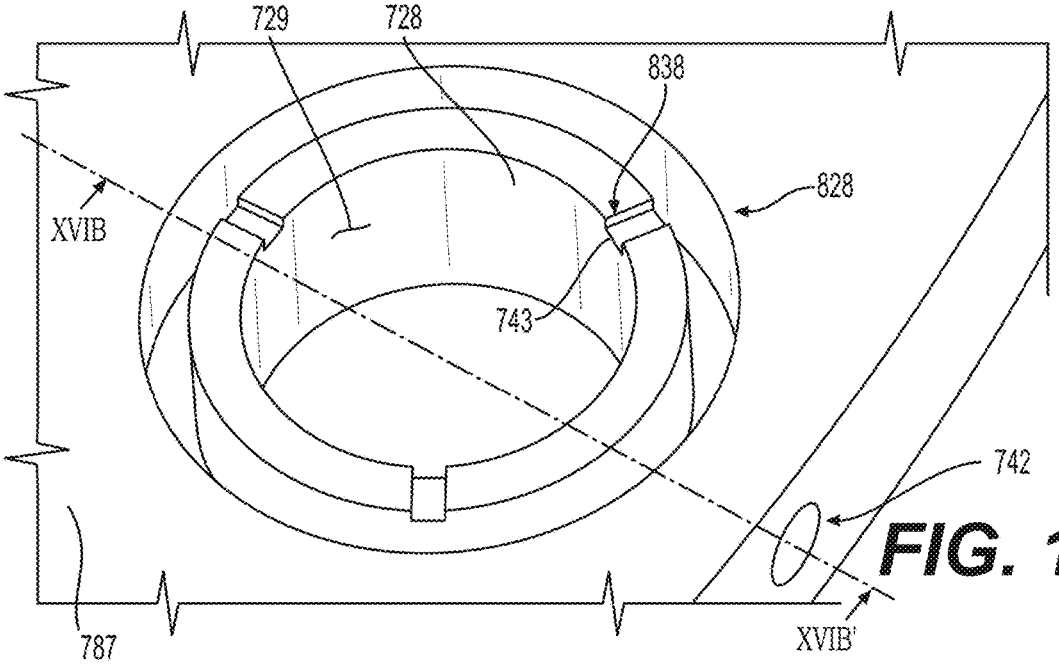
FIG. 16A is a perspective view of the region 'A' shown in FIG. 15.
Figure 16B:
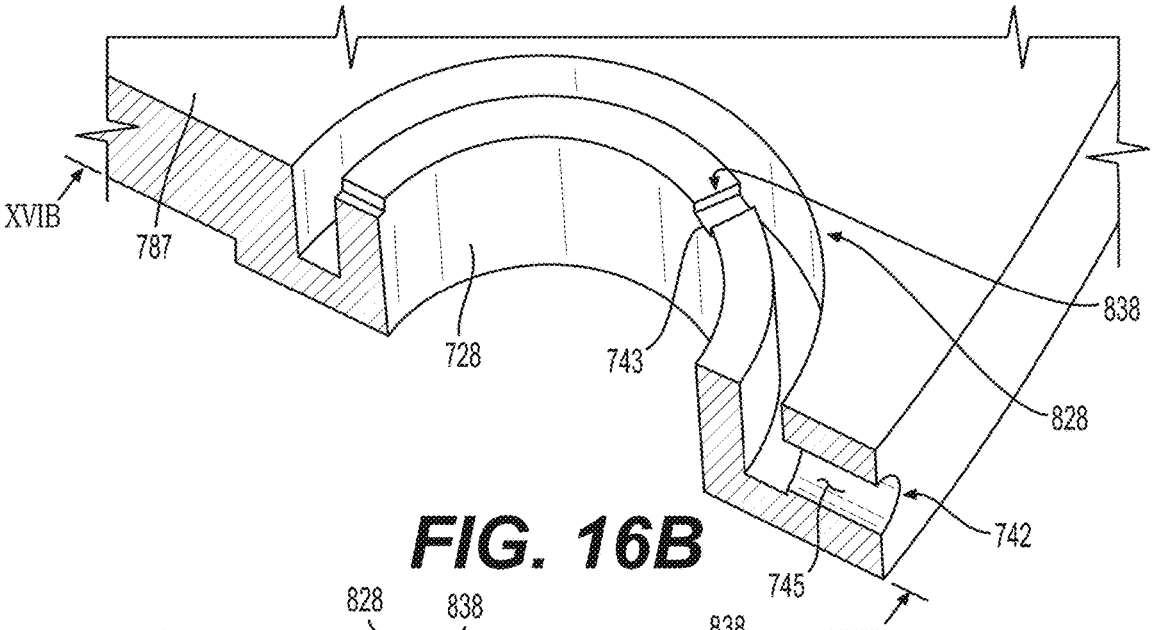
FIG. 16B is a three-dimensional cross-sectional view, along view line XVIB-XVIB', of the region 'A' shown in FIG. 15.
Figure 16C:
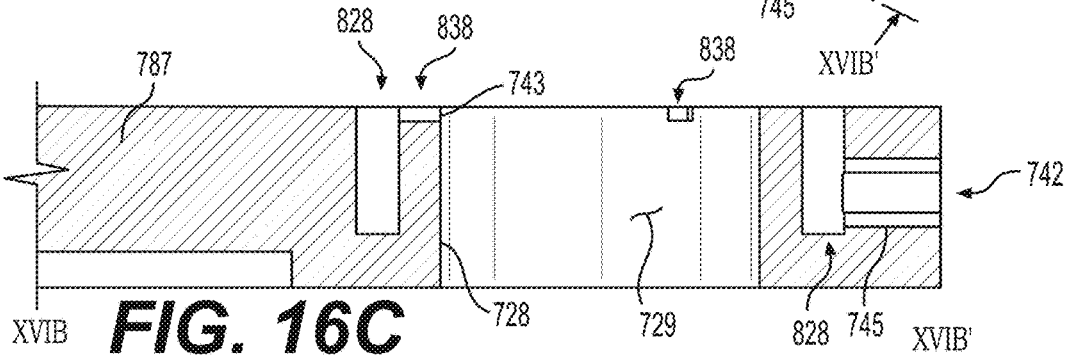
FIG. 16C is a two-dimensional cross-sectional view, along view line XVIB-XVIB', of the region 'A' shown in FIG. 15.

FIG. 15 is a perspective view of a disc 786 including a plurality of lower assemblies 712 of a plurality of channel assemblies 710 of the apparatus shown in FIG. 7. FIG. 16A is a perspective view of the region 'A' shown in FIG. 15. FIG. 16B is a three-dimensional cross-sectional view, along view line XVIB-XVIB', of the region 'A' shown in FIG. 15. FIG. 16C is a two-dimensional cross-sectional view, along view line XVIB-XVIB', of the region 'A' shown in FIG. 15.

As shown in FIGS. 15-16C, in some example embodiments an apparatus 100 may include an element, such as disc 786, that includes multiple portions 787-1 to 787-N that each comprise a separate lower assembly 712 of a separate channel assembly 710 of a plurality of channel assemblies 710 included in the apparatus 100. Thus, each separate portion 787 of the portions 787-1 to 787-N includes a separate lower inner surface 728 defining a separate lower channel 729, and a separate conduit assembly 744 configured to direct any second gas 107 delivered to an inlet 742 thereof to an outlet 743 in a top end of the lower inner surface 728 of the given portion 787. As shown in FIGS. 15-16C, each conduit assembly 744 of each separate, respective portion 787 may include an annular conduit assembly 828 surrounding the lower channel 729 of the portion 787, one or more bridging conduit assemblies 838 extending between the annular conduit assembly 828 and the lower inner surface 728 of the portion 787, and a conduit 745 extending from a separate inlet 742 of the portion 787 to the annular conduit assembly 828 of the portion 787. As a result, where the apparatus 100 includes a discharge assembly 740 that is configured to supply second gas 107 through an aligned inlet 742 and is further fixed in relation to a rotatable assembly 701 that includes disc 786, the rotatable assembly 701 may rotate to cause disc 786 to rotate around longitudinal axis 702, such that the portions 787-1 to 787-N may move in relation to a third position 830 wherein a given portion 787 may align with the fixed discharge assembly 740. Each annular conduit assembly 282, bridging conduit assembly 838, and conduit 745 as described herein may be any of the annular conduit assemblies, bridging conduit assemblies, and conduits described herein, respectively, including any of the annular conduit assembly 620, bridging conduit assembly 630, and conduit 610, respectively.

Example embodiments have been disclosed herein; it should be understood that other variations may be possible. Such variations are not to be regarded as a departure from the spirit and scope of the present disclosure, and all such modifications as would be obvious to one skilled in the art are intended to be included within the scope of the following claims.

We claim:

1. An apparatus, comprising:

a rotatable section configured to rotate around a central longitudinal axis, the rotatable section including a plurality of channel assemblies spaced about a circumference of the rotatable section, the plurality of channel assemblies including an upper channel configured to receive a compressible material; and a disc defining a plurality of conduit assemblies configured to be aligned with each of the plurality of channel assemblies and rotate about the central longitudinal axis at a same rate as the rotatable section, the plurality of conduit assemblies defining a lower channel of each of the plurality of channel assemblies, each of the plurality of conduit assemblies including, an annular conduit surrounding the lower channel, one or more bridging conduits between the annular conduit and the lower channel, an inlet defined by an outer surface of the disc, and a conduit extending between the inlet and the annular conduit, the conduit configured to receive a gas from the inlet and direct the gas through the annular conduit and the one or more bridging conduits to cause a portioned instance of the compressible material to be discharged from the lower channel.

2. The apparatus of claim 1, wherein the lower channel is configured to receive the portioned instance of the compressible material based on an instance of the compressible material being received from the upper channel through a top opening of the lower channel, and the instance of the compressible material being portioned by a cutting assembly configured to extend transversely between the rotatable section and the disc based on rotation of the rotatable section and the disc, the cutting assembly configured to cover the top opening of the lower channel and isolate the lower channel from the upper channel.

3. The apparatus of claim 1, wherein the plurality of channel assemblies are spaced apart in at least one ring pattern.

4. The apparatus of claim 3, wherein the plurality of channel assemblies includes a plurality of concentric ring patterns of channel assemblies.

5. The apparatus of claim 1, further comprising a discharge assembly configured to direct the gas into the inlet.

6. The apparatus of claim 1, wherein:

the annular conduit is configured to receive the gas from the inlet, and the one or more bridging conduits are configured to direct the gas from the annular conduit to a top opening of the lower channel.

7. The apparatus of claim 1, wherein:

the one or more bridging conduits are spaced apart equidistantly around a circumference of the lower channel.

8. The apparatus of claim 1, wherein a second gas directed through a top opening of the upper channel of each of the plurality of channel assemblies is configured to compress the compressible material.

9. The apparatus of claim 8, further comprising a gas source configured to supply the second gas.

10. A system, comprising:

a rotatable section configured to rotate around a central longitudinal axis, the rotatable section, the rotatable section including a plurality of channel assemblies spaced about a circumference of the rotatable section, each of the plurality of channel assemblies defining an upper channel configured to receive a compressible material, a disc defining a plurality of conduit assemblies configured to be aligned with each of the plurality of channel assemblies and rotate about the central longitudinal axis at a same rate as the rotatable section, the plurality of conduit assemblies defining a lower channel of each of the plurality of channel assemblies, each of the plurality of conduit assemblies including, an annular conduit surrounding the lower channel, one or more bridging conduits between the annular conduit and the lower channel, an inlet defined by an outer surface of the disc, and a conduit extending between the inlet and the annular conduit;

a cutting assembly configured to portion the compressible material based on moving the cutting assembly between the rotatable section and the disc to isolate the lower channel from the upper channel; and a discharge assembly fixed in relation to the rotatable section, the discharge assembly configured to supply a gas into the inlet of each of the plurality of channel assemblies to discharge a portioned instance of the compressible material from the lower channel.

11. The system of claim 10, wherein the plurality of channel assemblies are spaced apart in at least one ring pattern.

12. The system of claim 11, wherein the plurality of channel assemblies includes a plurality of concentric ring patterns of lower assemblies.

13. The system of claim 10, wherein:

the annular conduit is configured to receive the gas from the inlet, and the one or more bridging conduits are configured to direct the gas from the annular conduit to a top opening of the lower channel.

14. The system of claim 10, wherein:

the one or more bridging conduits are spaced apart equidistantly around a circumference of the lower channel.

15. The system of claim 10, further comprising a gas source configured to supply a second gas through a top opening of one of the plurality of channel assemblies to compress an instance of the compressible material held within the plurality of channel assemblies.

16. The system of claim 15, wherein the gas source is configured to compress the compressible material held within the plurality of channel assemblies based on rotation of the rotatable section to move a first one of the plurality of channel assemblies to a first position, such that the compressible material in the first one of the plurality of channel assemblies includes an upper material portion in the upper channel and a lower material portion in the lower channel.

17. The system of claim 16, wherein the gas source is configured to supply a continuous supply of the second gas, such that the continuous supply of the second gas through the top opening of the first one of the plurality of channel assemblies is controlled based on the first one of the plurality of channel assemblies moving in relation to the first position.

18. The system of claim 10, wherein:

the cutting assembly is configured to move in relation to the plurality of channel assemblies to extend transversely between the rotatable section and the disc based on rotation of the rotatable section to move a first one of the plurality of channel assemblies such that a lower material portion in the lower channel of the first one of the plurality of channel assemblies is severed from an upper material portion in the upper channel to produce the portioned instance; and wherein a top opening of the lower channel is covered by a lower surface of the cutting assembly.

19. The system of claim 18, wherein the cutting assembly is fixed in relation to the plurality of channel assemblies, such that the cutting assembly is configured to extend transversely between the upper channel and the lower channel of the first one of the plurality of channel assemblies based on the rotatable section rotating to move the first one of the plurality of channel assemblies.

20. The system of claim 10, further comprising a weight sensor configured to generate sensor data indicating a weight of portioned instances discharged from the lower channel of each channel assembly of the plurality of channel assemblies.

* * * * *